US010427009B2

(12) United States Patent
Shigemitsu et al.

(10) Patent No.: US 10,427,009 B2
(45) Date of Patent: Oct. 1, 2019

(54) MULTI-PIECE GOLF BALL

(71) Applicant: DUNLOP SPORTS CO. LTD., Kobe-shi, Hyogo (JP)

(72) Inventors: Takahiro Shigemitsu, Kobe (JP); Hidetaka Inoue, Kobe (JP); Seiji Hayase, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 42 days.

(21) Appl. No.: 14/979,079

(22) Filed: Dec. 22, 2015

(65) Prior Publication Data

US 2016/0184656 A1 Jun. 30, 2016

(30) Foreign Application Priority Data

Dec. 26, 2014 (JP) ..... 2014-266652
May 28, 2015 (JP) ..... 2015-108705

(51) Int. Cl.
*A63B 37/06* (2006.01)
*A63B 37/00* (2006.01)

(52) U.S. Cl.
CPC ..... *A63B 37/0092* (2013.01); *A63B 37/0031* (2013.01); *A63B 37/0035* (2013.01); *A63B 37/0043* (2013.01); *A63B 37/0047* (2013.01); *A63B 37/0062* (2013.01); *A63B 37/0066* (2013.01); *A63B 37/0076* (2013.01); *A63B 37/0069* (2013.01)

(58) Field of Classification Search
CPC ..... A63B 37/0046
USPC ..... 473/376
See application file for complete search history.

(56) References Cited

U.S. PATENT DOCUMENTS

2002/0034987 A1 3/2002 Yamagishi et al.
2009/0011855 A1 1/2009 Sullivan et al.

FOREIGN PATENT DOCUMENTS

JP 8-336617 A 12/1996
JP 2009-233335 A 10/2009

*Primary Examiner* — Raeann Gorden
(74) *Attorney, Agent, or Firm* — Birch, Stewart, Kolasch & Birch, LLP

(57) ABSTRACT

An object of the present invention is to provide a golf ball showing a small ratio of a spin rate on driver shots to a spin rate on approach shots. The present invention provides a multi-piece golf ball comprising a spherical center, three or more envelope layers covering the spherical center, and a cover covering the envelope layers, wherein adjacent two envelope layers are formed so as to include a region composed of elements having a hitting deformation ratio of 30% or more, the hitting deformation ratio being obtained by analyzing a specified golf ball model by a finite element method; and the envelope layer which is radially outwardly positioned of the adjacent two envelope layers has a lowest hardness among all the envelope layers.

21 Claims, 15 Drawing Sheets

MULTI-PIECE GOLF BALL

FIELD OF THE INVENTION

The present invention relates to a multi-piece golf ball, and more specifically relates to a multi-piece golf ball showing a small ratio of a spin rate on driver shots to a spin rate on approach shots.

DESCRIPTION OF THE RELATED ART

As a method of inhibiting the spin rate on driver shots, a method of controlling the hardness distribution of the golf ball is exemplified. For example, by adopting an outer-hard and inner-soft hardness distribution in the golf ball, the spin rate on driver shots can be lowered, thus the flight distance on driver shots can be increased.

As the golf ball having a controlled hardness distribution, for example, Japanese Patent Publication No. H08-336617 A discloses a multi-piece solid golf ball having a structure of at least four layers consisting of a core having a structure of at least two layers and two cover layers covering the core, wherein the outer cover has a hardness of 40 to 60 in Shore D hardness, and the inner cover has a hardness of 53 or less in Shore D hardness and lower than the hardness of the outer cover.

Japanese Patent Publication No. 2009-233335 A discloses a golf ball including: a unitary core having a volume, an outer surface, a geometric center, and an outermost transition part adjacent to the outer surface, the core being formed from a substantially homogenous composition; and a cover layer, wherein the outermost transition part is disposed between the core outer surface and the geometric center, the transition part has an outer portion congruent with the core outer surface and comprises the outermost 45% of the core volume or less, and both a hardness of the core outer surface and a hardness within the outermost transition part are less than a hardness of the geometric center to define a negative hardness gradient.

SUMMARY OF THE INVENTION

By adopting the outer-hard and inner-soft hardness distribution in the golf ball, the spin rate on driver shots can be lowered. However, in this case, not only the spin rate on driver shots is lowered, but also the spin rate on approach shots tends to be lowered. Therefore, although the golf ball having the outer-hard and inner-soft structure shows an improved flight distance on driver shots, its controllability on approach shots tends to be lowered.

The present invention has been achieved in view of the above problems, and an object thereof is to provide a golf ball showing a small ratio of a spin rate on driver shots to a spin rate on approach shots.

The present invention provides a multi-piece golf ball comprising a spherical center, three or more envelope layers covering the spherical center, and a cover covering the envelope layers, wherein adjacent two envelope layers are formed so as to include a region composed of elements having a hitting deformation ratio of 30% or more, the hitting deformation ratio being obtained by analyzing a golf ball model described in Table 1 shown below by a finite element method; and the envelope layer which is radially outwardly positioned of the adjacent two envelope layers has a lowest hardness (Hs) among all the envelope layers.

TABLE 1

| | Distance (mm) from central point of golf ball | Distance (%) from central point of golf ball | Hardness (Shore C) | Tensile modulus (MPa) | Poisson's ratio | Density (g/cm$^3$) |
|---|---|---|---|---|---|---|
| Core 1 | 0-2.00 mm | 0%-9.4% | 70 | 53 | 0.49 | 1.118 |
| Core 2 | 2.00-4.00 mm | 9.4%-18.7% | 72 | 57 | 0.49 | 1.118 |
| Core 3 | 4.00-6.00 mm | 18.7%-28.1% | 73 | 64 | 0.49 | 1.118 |
| Core 4 | 6.00-8.00 mm | 28.1%-37.5% | 74 | 65 | 0.49 | 1.118 |
| Core 5 | 8.00-10.00 mm | 37.5%-46.8% | 74 | 65 | 0.49 | 1.118 |
| Core 6 | 10.00-12.00 mm | 46.8%-56.2% | 74 | 65 | 0.49 | 1.118 |
| Core 7 | 12.00-14.00 mm | 56.2%-65.6% | 74 | 65 | 0.49 | 1.118 |
| Core 8 | 14.00-16.00 mm | 65.6%-74.9% | 77 | 77 | 0.49 | 1.118 |
| Core 9 | 16.00-18.00 mm | 74.9%-84.3% | 77 | 77 | 0.49 | 1.118 |
| Core 10 | 18.00-18.85 mm | 84.3%-88.3% | 79 | 88 | 0.49 | 1.118 |
| Core 11 | 18.85-19.35 mm | 88.3%-90.6% | 81 | 97 | 0.49 | 1.118 |
| Core 12 | 19.35-19.85 mm | 90.6%-93.0% | 83 | 108 | 0.49 | 1.118 |
| Intermediate layer | 19.85-20.85 mm | 93.0%-97.7% | 94 | 290 | 0.49 | 0.989 |
| Cover | 20.85-21.35 mm | 97.7%-100% | 46 | 16 | 0.49 | 1.101 |

The element having the hitting deformation ratio of 30% or more when the golf ball model described in Table 1 shown above is analyzed by the finite element method means a spot showing a high compression deformation ratio among finite elements constituting the golf ball, when the golf ball is hit with a driver. The gist of the present invention is to selectively lower the spin rate on driver shots by appropriately controlling the physical properties of a region showing a high compression deformation ratio in the internal construction of the golf ball. In other words, the spin rate on driver shots can be selectively lowered by forming the adjacent two envelope layers of the envelope layers covering the spherical center such that the adjacent two envelope layers include a region composed of the elements having the hitting deformation ratio of 30% or more, the hitting deformation ratio being obtained by analyzing the golf ball model by the finite element method, and making the envelope layer which is radially outwardly positioned of the adjacent two envelope layers have a lowest hardness (Hs) among all the envelope layers. According to the present invention, the spin rate on driver shots can be lowered independently from the spin rate on approach shots, and thus a golf ball showing a small ratio of a spin rate on driver shots to a spin rate on approach shots can be obtained.

According to the present invention, a golf ball having an optimized hardness distribution and showing a small ratio of a spin rate on driver shots to a spin rate on approach shots can be obtained. The golf ball showing a small ratio of a spin rate on driver shots to a spin rate on approach shots travels a great distance on driver shots and is excellent in controllability on approach shots.

DESCRIPTION OF THE PREFERRED EMBODIMENT

Figure 1:
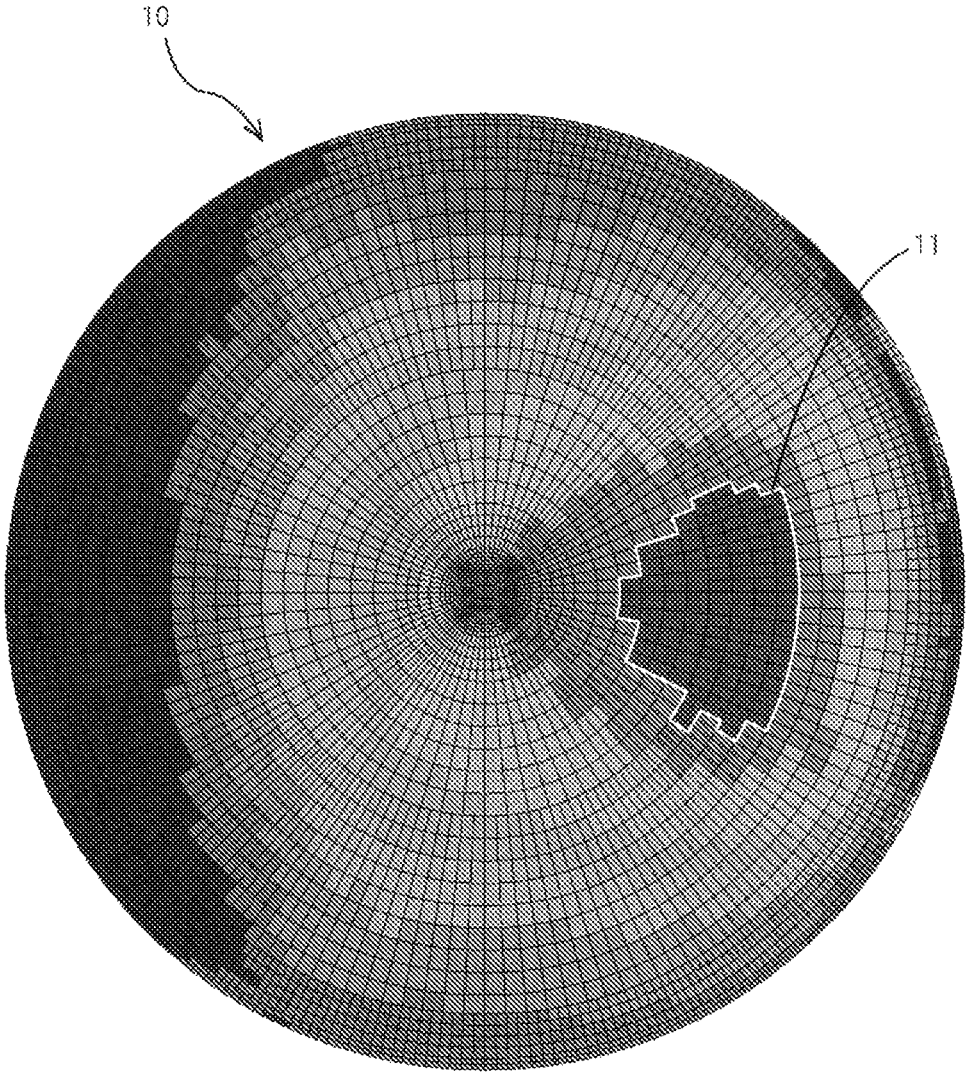
FIG. 1 is a cross-sectional view showing a distribution of elements having a hitting deformation ratio of 30.0% or more, among elements obtained by dividing a golf ball model.

The present invention provides a multi-piece golf ball comprising a spherical center, three or more envelope layers covering the spherical center, and a cover covering the envelope layers, wherein adjacent two envelope layers are formed so as to include a region composed of elements having a hitting deformation ratio of 30% or more, the hitting deformation ratio being obtained by analyzing a golf ball model described in Table 1 shown above by a finite element method; and the envelope layer which is radially outwardly positioned of the adjacent two envelope layers has a lowest hardness (Hs) among all the envelope layers.

(1) Construction of Golf Ball

The multi-piece golf ball according to the present invention comprises a spherical center, three or more envelope layers covering the spherical center, and a cover covering the envelope layers. The envelope layers are preferably three or more layers, more preferably four or more layers, and are preferably ten or less layers, more preferably nine or less layers. If the envelope layers are three or more layers, it becomes easier to control the hardness distribution of the golf ball. On the other hand, if the number of the envelope layers is excessively large, the moldability of the envelope layers is lowered. It is noted that a paint film and a reinforcement layer (adhesive agent layer) provided to improve adhesion between the envelope layers are not included in the envelope layers. The paint film and the reinforcement layer (adhesive agent layer) have a different film thickness range from the envelope layers. The paint film and the reinforcement layer (adhesive agent layer) generally have a film thickness of 50 μm (0.050 mm) or less, whereas the envelope layer generally has a thickness of at least 0.1 mm.

In the present invention, among the three or more envelope layers covering the spherical center, the adjacent two envelope layers are formed so as to include a region composed of the elements having a hitting deformation ratio of 30% or more, the hitting deformation ratio being obtained by analyzing the golf ball model described in Table 1 shown above by the finite element method. Next, the method analyzing the golf ball model by the finite element method will be explained in detail.

(a) The golf ball model having a configuration described in Table 1 shown above is employed as a golf ball model. The golf ball model comprises a twelve-layered spherical core, an intermediate layer covering the spherical core, and a cover covering the intermediate layer. In the present invention, the golf ball model having a golf ball radius of 21.35 mm is employed, however, a golf ball model having a different golf ball radius may also be employed. In this case, a new golf ball model can be designed according to the distance (%) from the central point of the golf ball. Specifically, Poisson's ratio and density of the material constituting each layer are provided, the Poisson's ratio is set to 0.49, and the density of each layer is calculated according to the formulation of each layer.

(b) The golf ball model is divided into elements. That is, the golf ball is divided by radial lines, circumferential lines (longitudinal direction) and circumferential lines (latitudinal direction). The number of division in the circumferential direction is preferably 40 to 400. The number of division in the radial direction is preferably 20 to 50. The number of the elements formed by division is preferably ten thousands to one million. If the number of the elements to be analyzed falls within the above range, the analysis accuracy is better and the analysis cost improves. In the present invention, specifically, the golf ball model is divided into 320 sections in the circumferential direction, and is divided into 39 sections in the radial direction. Accordingly, the golf ball is divided into 320 thousand elements.

Element division of the vertical cross section of the golf ball will be described in detail. Element division is conducted on a vertical cross section obtained by cutting the golf ball into halves and the vertical cross section includes the central point and a hitting point of the golf ball. The length of each element in the radial direction is set at 0.5 mm in a distance range of 2 to 4 mm from the central point, is set at 1.0 mm in a distance range of 4 to 18 mm from the central point, is set at 0.85 mm in a distance range of 18 to 18.85 mm from the central point, is set at 0.5 mm in a distance range of 18.85 mm to 20.85 mm from the central point, and is set at 0.25 mm in a distance range of 20.85 to 21.35 mm from the central point. The number of division in the circumferential direction is set at 80 in a distance range of 2 to 10 mm from the central point, is set at 160 in a distance range of 10 to 18.85 mm from the central point, and is set at 320 in a distance range of 18.85 to 21.35 mm from the central point.

(c) Assuming that the golf ball model divided into the elements as described above is hit with a driver having a loft angle of 12 degrees at a head speed of 40 m/s, the hitting deformation ratio of each element is calculated using LS-DYNA (analysis software manufactured by LSTC). The hitting conditions are set as follows. A golf ball is caused to collide against a rigid plate (weight: 193.8 g, size: 30 mm×40 mm×0.2 mm) such that a predetermined speed (40 m/s) and a predetermined loft angle (12 degrees) are obtained.

(d) The deformation ratio (von Mises strain) at the time when the golf ball model mostly deforms is calculated by HyperView (Altair Engineering, Inc.).

(e) Through the analysis, the elements constituting the golf ball model are classified based on the hitting deformation ratio. The analysis is conducted on a vertical cross section obtained by cutting the golf ball into halves and the vertical cross section includes the central point and a hitting point of the golf ball. Specifically, the elements are classified into: elements having a hitting deformation ratio of 0% or more and less than 3.8%; elements having a hitting deformation ratio of 3.8% or more and less than 7.5%; elements having a hitting deformation ratio of 7.5% or more and less than 11.3%; elements having a hitting deformation ratio of 11.3% or more and less than 15.0%; elements having a hitting deformation ratio of 15.0% or more and less than 18.8%; elements having a hitting deformation ratio of 18.8% or more and less than 22.5%; elements having a hitting deformation ratio of 22.5% or more and less than 26.3%; elements having a hitting deformation ratio of 26.3% or more and less than 30.0%; and elements having a hitting deformation ratio of 30.0% or more. The upper limit of the hitting deformation ratio is not particularly limited, but is preferably less than 50%, and more preferably less than 46.7%.

Figure 2:
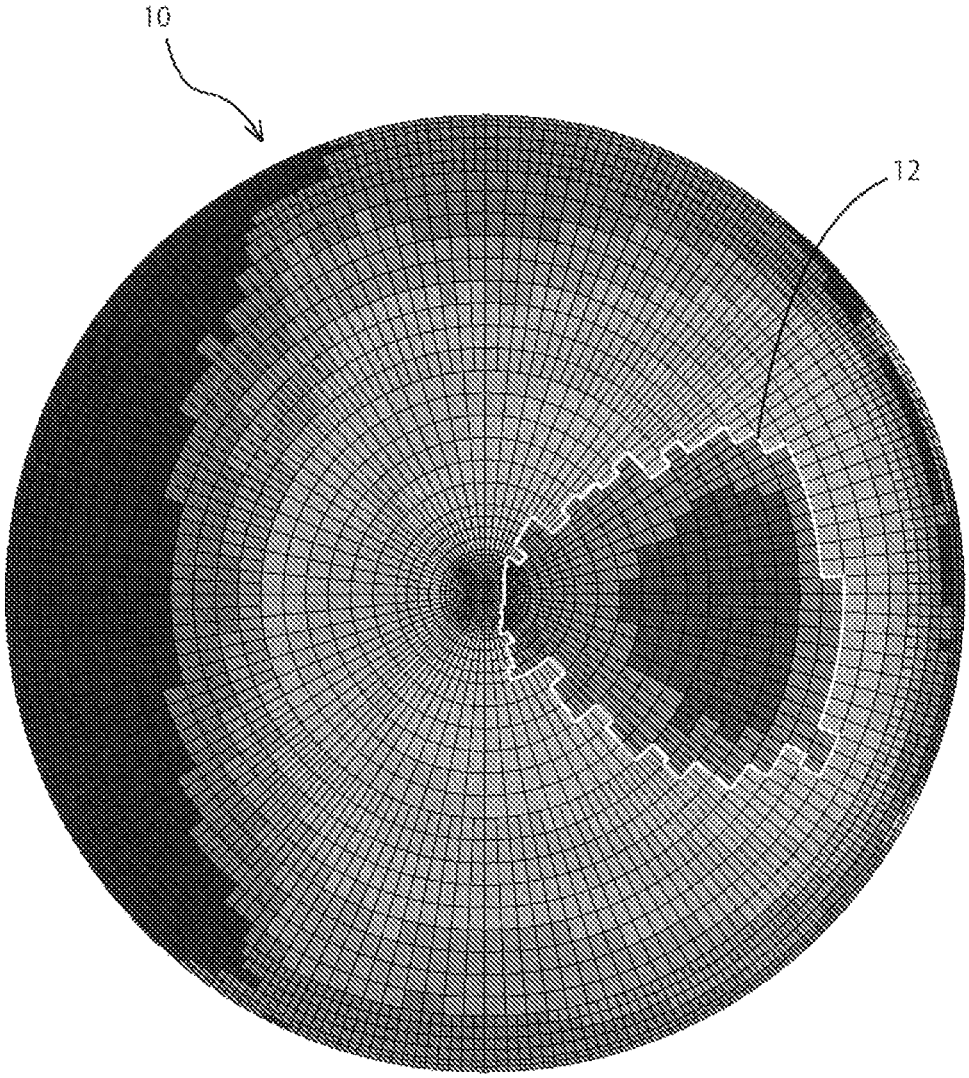
FIG. 2 is a cross-sectional view showing a distribution of elements having a hitting deformation ratio of 26.3% or more, among elements obtained by dividing a golf ball model.
Figure 3:
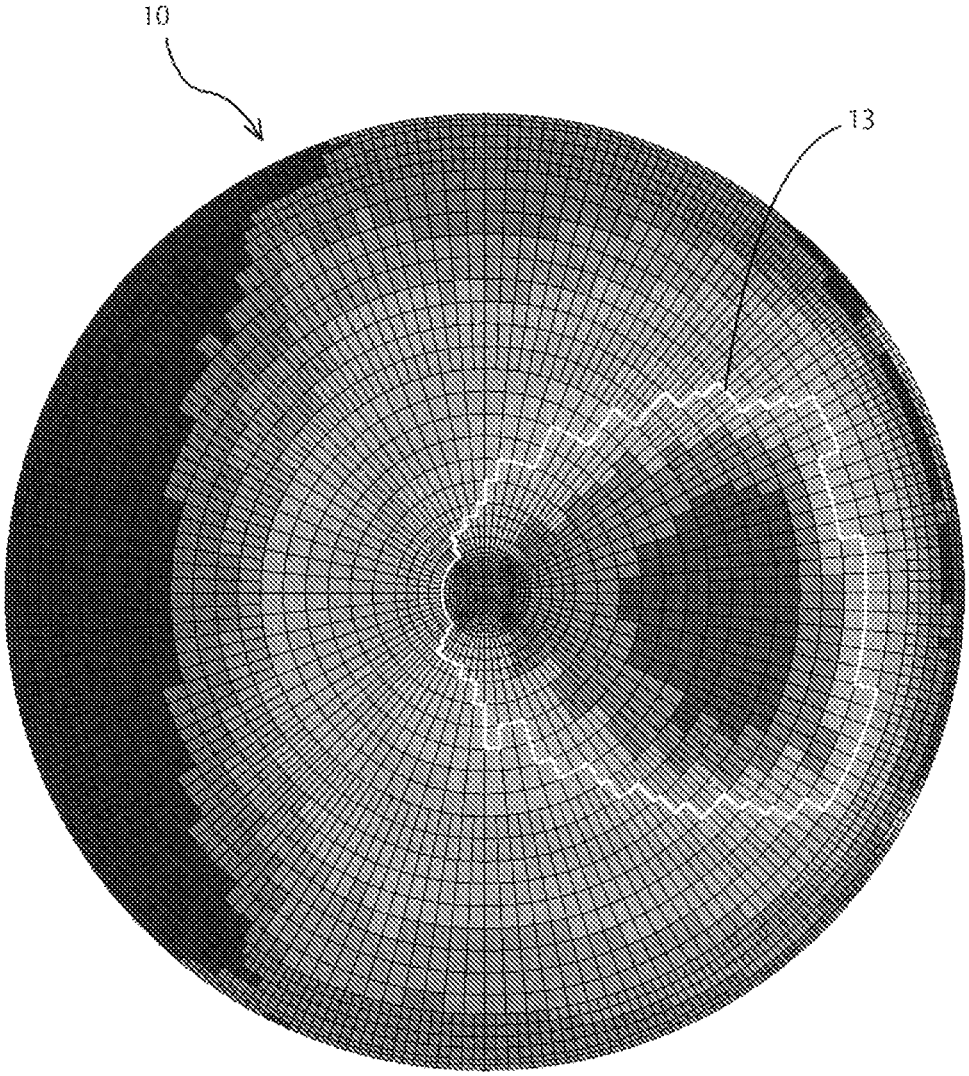
FIG. 3 is a cross-sectional view showing a distribution of elements having a hitting deformation ratio of 22.5% or more, among elements obtained by dividing a golf ball model.
Figure 4:
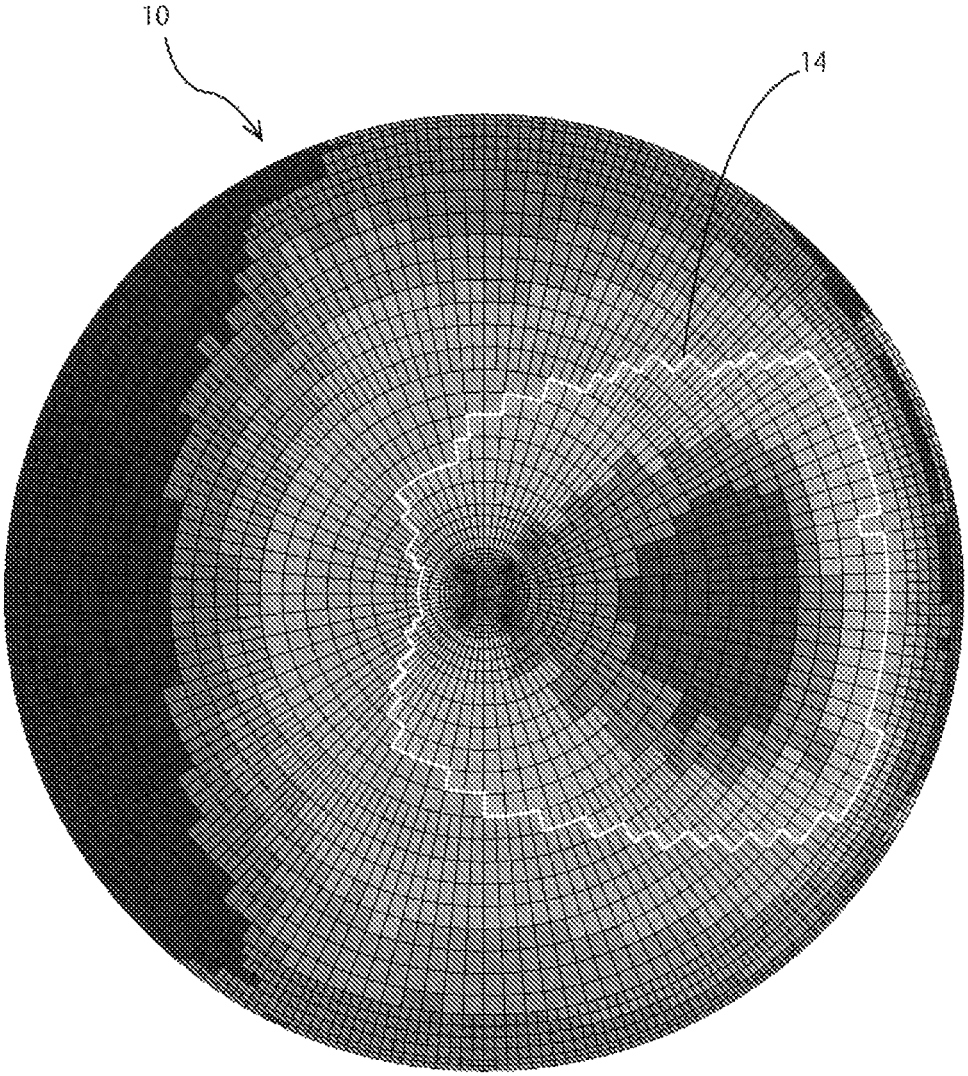
FIG. 4 is a cross-sectional view showing a distribution of elements having a hitting deformation ratio of 18.8% or more, among elements obtained by dividing a golf ball model.
Figure 5:
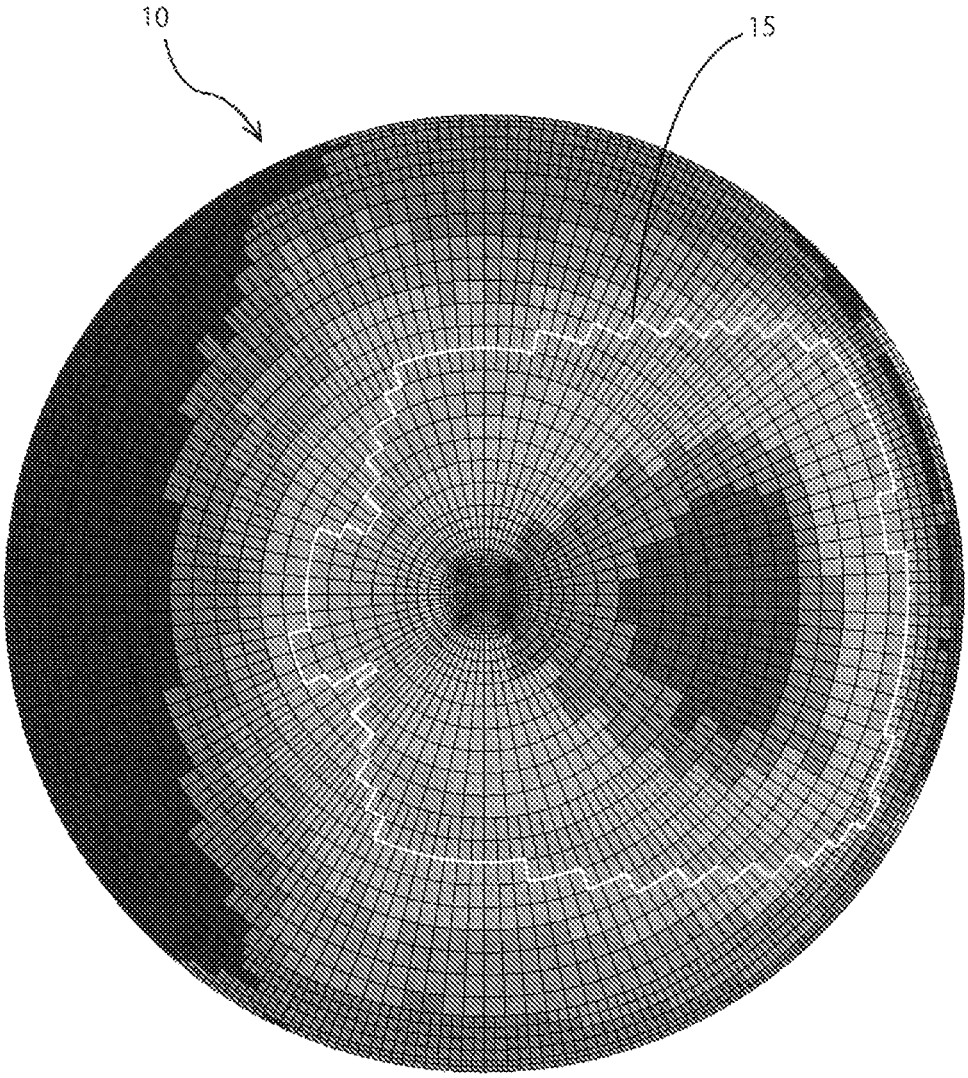
FIG. 5 is a cross-sectional view showing a distribution of elements having a hitting deformation ratio of 15.0% or more, among elements obtained by dividing a golf ball model.
Figure 6:
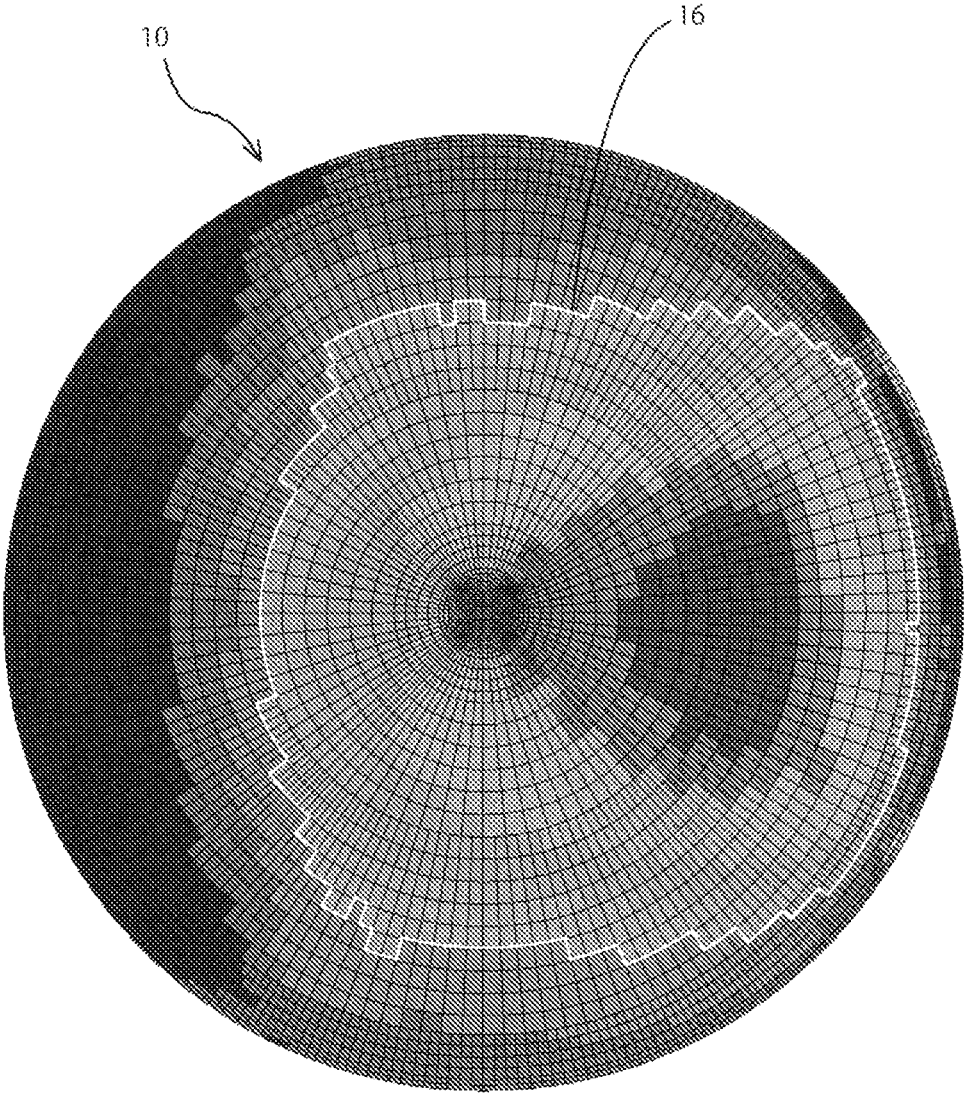
FIG. 6 is a cross-sectional view showing a distribution of elements having a hitting deformation ratio of 11.3% or more, among elements obtained by dividing a golf ball model.
Figure 7:
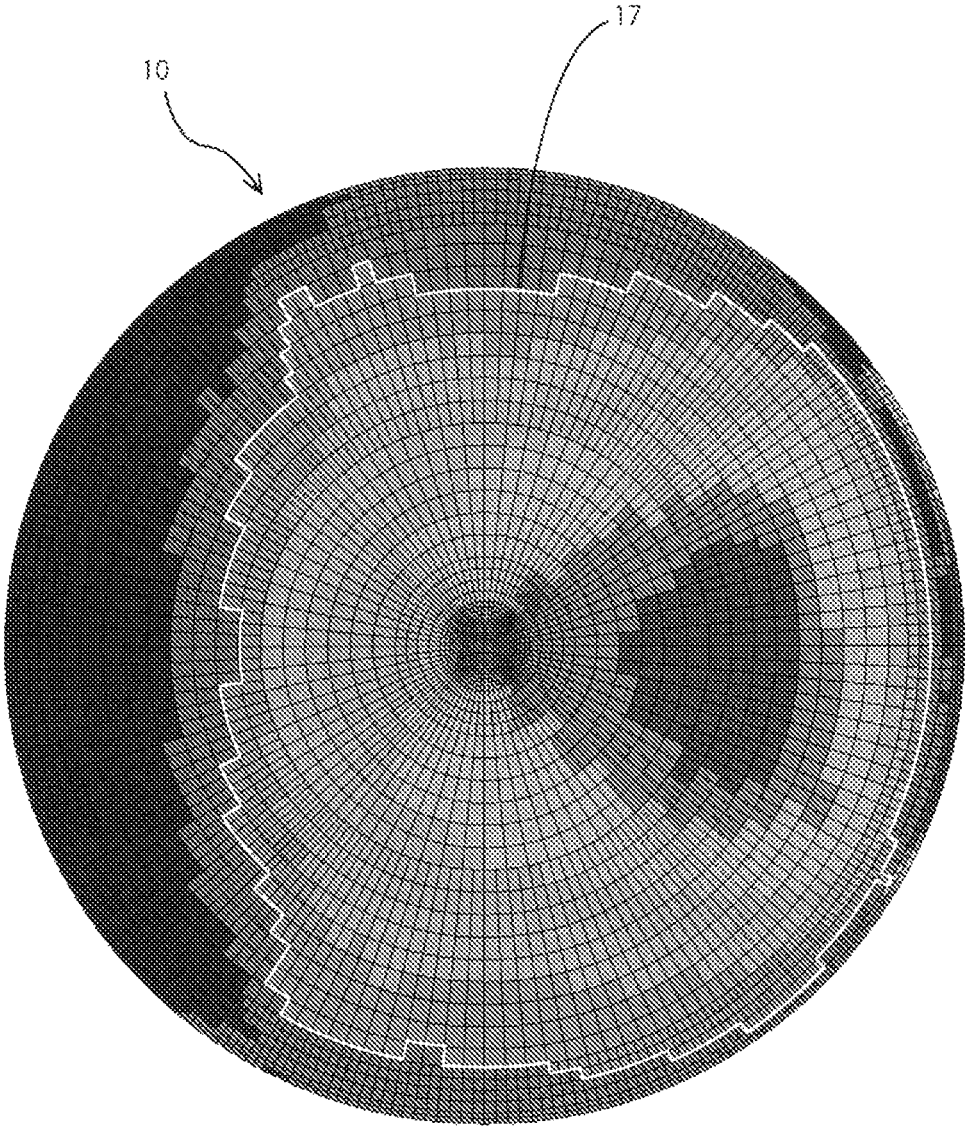
FIG. 7 is a cross-sectional view showing a distribution of elements having a hitting deformation ratio of 7.5% or more, among elements obtained by dividing a golf ball model.
Figure 8:
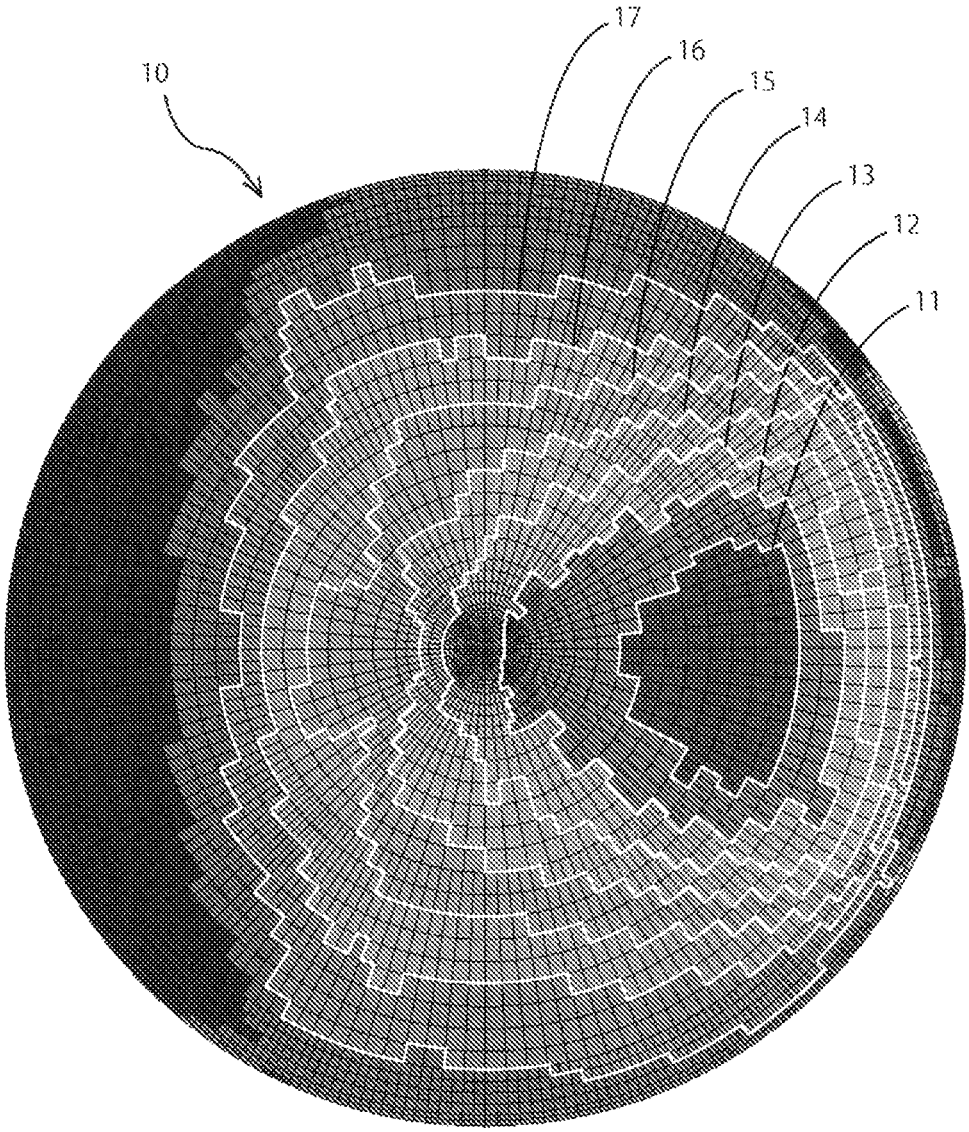
FIG. 8 is a cross-sectional view showing overlapped regions composed of the elements having different hitting deformation ratios in FIGS. 1 to 7.

FIG. 1 shows a distribution of the elements having a hitting deformation ratio of 30.0% or more among the elements obtained by dividing the golf ball model. The region surrounded by a border line 11 is a region composed of the elements having a hitting deformation ratio of 30.0% or more. FIG. 2 shows a distribution of the elements having a hitting deformation ratio of 26.3% or more among the elements obtained by dividing the golf ball model. The region surrounded by a border line 12 is a region composed of the elements having a hitting deformation ratio of 26.3% or more. FIG. 3 shows a distribution of the elements having a hitting deformation ratio of 22.5% or more among the elements obtained by dividing the golf ball model. The region surrounded by a border line 13 is a region composed of the elements having a hitting deformation ratio of 22.5% or more. FIG. 4 shows a distribution of the elements having a hitting deformation ratio of 18.8% or more among the elements obtained by dividing the golf ball model. The region surrounded by a border line 14 is a region composed of the elements having a hitting deformation ratio of 18.8% or more. FIG. 5 shows a distribution of the elements having a hitting deformation ratio of 15.0% or more among the elements obtained by dividing the golf ball model. The region surrounded by a border line 15 is a region composed of the elements having a hitting deformation ratio of 15.0% or more. FIG. 6 shows a distribution of the elements having a hitting deformation ratio of 11.3% or more among the elements obtained by dividing the golf ball model. The region surrounded by a border line 16 is a region composed of the elements having a hitting deformation ratio of 11.3% or more. FIG. 7 shows a distribution of the elements having a hitting deformation ratio of 7.5% or more among the elements obtained by dividing the golf ball model. The region surrounded by a border line 17 is a region composed of the elements having a hitting deformation ratio of 7.5% or more. FIG. 8 shows, in an overlapping manner, the regions composed of the elements having different hitting deformation ratios shown in FIGS. 1 to 7. FIGS. 1 to 8 each show a cross-sectional view including the central point of a golf ball 10, and the golf ball is hit from the right side of the sheet surface of the drawing. In the golf ball model, the cover is flexible and thus the hitting deformation ratio is high. Therefore, a region excluding the cover is made a target to be analyzed.

In the multi-piece golf ball of the present invention, adjacent two envelope layers among three or more envelope layers covering the spherical center are formed so as to include a region composed of elements having a hitting deformation ratio of 30% or more, the hitting deformation ratio being obtained by analyzing the above golf ball model by a finite element method; and the envelope layer which is radially outwardly positioned of the adjacent two envelope layers has a lowest hardness (Hs) among all the envelope layers. It is noted that, in the present invention, the envelope layer having the lowest hardness (Hs) among all the envelope layers is sometimes referred to as the lowest hardness envelope layer (Es). The multi-piece golf ball is not limited as long as it comprises two envelope layers satisfying the above requirements, for example, the multi-piece golf ball may further comprise an envelope layer including a region composed of the elements having a hitting deformation ratio of 30% or more, on the outer side of the lowest hardness envelope layer.

The thickness of the lowest hardness envelope layer (Es) is preferably 0.2 mm or more, more preferably 0.5 mm or more, and even more preferably 1.0 mm or more, and is preferably 20 mm or less, more preferably 17 mm or less, and even more preferably 15 mm or less. If the thickness of the lowest hardness envelope layer (Es) is 0.2 mm or more, the spin rate on driver shots is effectively lowered, and if the thickness of the lowest hardness envelope layer (Es) is 20 mm or less, the resilience of the golf ball is not lowered.

The material hardness (Hs) of the lowest hardness envelope layer (Es) is preferably 2 or more, more preferably 3 or more, and even more preferably 5 or more, and is preferably 40 or less, more preferably 35 or less, even more preferably 30 or less, and particularly preferably 25 or less in Shore D hardness. If the material hardness (Hs) of the lowest hardness envelope layer (Es) falls within the above range, the spin rate on driver shots is selectively lowered. As a result, a golf ball showing a small ratio of a spin rate on driver shots to a spin rate on approach shots can be obtained. It is also more preferred that the material hardness (Hs) of the lowest hardness envelope layer (Es) is made a lowest hardness among the material hardness of the golf ball constituent materials (including spherical center and cover). Hereinafter, "material hardness (Hs)" is sometimes merely referred to as "lowest hardness (Hs)".

The tensile elastic modulus of the material forming the lowest hardness envelope layer is preferably 1 MPa or more, more preferably 2 MPa or more, and even more preferably 3 MPa or more, and is preferably 20 MPa or less, more preferably 18 MPa or less, and even more preferably 16 MPa or less. If the tensile elastic modulus is 1 MPa or more, the resilience of the golf ball is not lowered, and if the tensile elastic modulus is 20 MPa or less, the spin rate on driver shots is easily lowered. Further, it is preferred that the tensile elastic modulus of the material forming the lowest hardness envelope layer is a lowest tensile elastic modulus among the tensile elastic moduli of all the envelope layer materials.

In the present invention, the slab hardness of all the envelope layers including the region composed of the elements having the hitting deformation ratio of 30% or more is preferably 50 or less, more preferably 40 or less, and is preferably 5 or more, more preferably 10 or more in Shore D hardness. If the slab hardness of all the envelope layers including the region composed of the elements having the hitting deformation ratio of 30% or more falls within the above range, the spin rate on driver shots is effectively lowered, and the resilience of the golf ball is not lowered.

Further, in the present invention, the outermost envelope layer among the envelope layers preferably has a highest hardness (Hh) among all the envelope layers, and is more preferably formed from a material having a highest material hardness among the golf ball constituent materials. If the outermost envelope layer is formed from a material having a highest material hardness, the spin rate on driver shots is lowered. Hereinafter, the "envelope layer formed from a material having a highest material hardness (Hh) among all the envelope layers" is sometimes merely referred to as the "highest hardness envelope layer (Eh)". The outermost envelope layer preferably does not include a region composed of the elements having a hitting deformation ratio of 30% or more. Further, the highest hardness envelope layer (Eh) and the lowest hardness envelope layer (Es) are preferably not in contact with each other. In other words, another envelope layer is preferably disposed between the highest hardness envelope layer (Eh) and the lowest hardness envelope layer (Es).

When only adjacent two envelope layers of the multi-piece golf ball include the region composed of the elements having the hitting deformation ratio of 30% or more, the envelope layer which is radially outwardly positioned of the adjacent two envelope layers preferably has a lowest hardness (Hs) among all the envelope layers. By adopting such configuration, the spin rate on driver shots can be selectively lowered. In addition, when only adjacent three envelope layers of the multi-piece golf ball include the region composed of the elements having the hitting deformation ratio of 30% or more, the envelope layer located at a middle position among the adjacent three envelope layers more preferably has a lowest hardness among all the envelope layers.

The thickness of the highest hardness envelope layer (Eh) is preferably 0.1 mm or more, more preferably 0.2 mm or more, and even more preferably 0.5 mm or more, and is preferably 5 mm or less, more preferably 4 mm or less, and even more preferably 3 mm or less. If the thickness of the highest hardness envelope layer (Eh) is 0.1 mm or more, the durability of the golf ball can be sufficiently maintained, and if the thickness of the highest hardness envelope layer (Eh) is 5 mm or less, the shot feeling is better.

The material hardness (Hh) of the highest hardness envelope layer (Eh) is preferably 30 or more, more preferably 35 or more, even more preferably 40 or more, and particularly preferably 55 or more, and is preferably 85 or less, more preferably 80 or less, and even more preferably 77 or less in Shore D hardness. If the material hardness (Hh) is 30 or more, the spin rate on driver shots is lowered, and if the material hardness (Hh) is 85 or less, the shot feeling is better. Hereinafter, "material hardness (Hh)" is sometimes merely referred to as "highest hardness (Hh)".

The ratio (Hh/Hs) (Shore D hardness) of the highest hardness (Hh) to the lowest hardness (Hs) is preferably 1.1 or more, more preferably 1.2 or more, and even more preferably 1.3 or more, and is preferably 45 or less, more preferably 35 or less, and even more preferably 30 or less. If the ratio (Hh/Hs) is 1.1 or more, the spin rate on driver shots is effectively lowered, and if the ratio (Hh/Hs) is 45 or less, the shot feeling is better.

The hardness difference (Hh−Hs) between the highest hardness (Hh) and the lowest hardness (Hs) is preferably 30 or more, more preferably 32 or more, and even more preferably 34 or more, and is preferably 80 or less, more preferably 75 or less, and even more preferably 70 or less in Shore D hardness. If the hardness difference (Hh−Hs) is 30 or more in Shore D hardness, the spin rate on driver shots is effectively lowered, and if the hardness difference (Hh−Hs) is 80 or less in Shore D hardness, the shot feeling is better.

The tensile elastic modulus of the material forming the highest hardness envelope layer is preferably 150 MPa or more, more preferably 200 MPa or more, and is preferably 400 MPa or less, more preferably 300 MPa or less. The ratio (highest hardness envelope layer/lowest hardness envelope layer) of the tensile elastic modulus of the material forming the highest hardness envelope layer to the tensile elastic modulus of the material forming the lowest hardness envelope layer is preferably 8 or more, more preferably 10 or more, and is preferably 50 or less, more preferably 40 or less.

The material hardness (Ho) of the spherical center is preferably 15 or more, more preferably 20 or more, even more preferably 25 or more, and particularly preferably 30 or more, and is preferably 55 or less, more preferably 50 or less, and even more preferably less than 45 in Shore D hardness. If the material hardness (Ho) of the spherical center falls within the above range, the resilience of the golf ball is not lowered.

The ratio (Ho/Hs) (Shore D hardness) of the material hardness (Ho) to the lowest hardness (Hs) is preferably 1.05 or more, more preferably 1.10 or more, and even more preferably 1.15 or more, and is preferably 30 or less, more preferably 20 or less, and even more preferably 10 or less. If the ratio (Ho/Hs) is 1.05 or more, the spin rate on driver shots is effectively lowered, and if the ratio (Ho/Hs) is 30 or less, the durability of the golf ball is sufficiently maintained.

The hardness difference (Ho−Hs) between the material hardness (Ho) and the lowest hardness (Hs) is preferably 1 or more, more preferably 2 or more, and even more preferably 3 or more, and is preferably 50 or less, more preferably 45 or less, and even more preferably 40 or less in Shore D hardness. If the hardness difference (Ho−Hs) is 1 or more in Shore D hardness, the spin rate on driver shots is effectively lowered, and if the hardness difference (Ho−Hs) is 50 or less in Shore D hardness, the durability of the golf ball is sufficiently maintained.

The ratio (Hh/Ho) (Shore D hardness) of the highest hardness (Hh) to the material hardness (Ho) is preferably 1.0 or more, more preferably 1.1 or more, and even more preferably 1.2 or more, and is preferably 45 or less, more preferably 40 or less, and even more preferably 35 or less. If the ratio (Hh/Ho) is 1.0 or more, the spin rate on driver shots is effectively lowered, and if the ratio (Hh/Ho) is 45 or less, the durability of the golf ball is sufficiently maintained.

The hardness difference (Hh−Ho) between the highest hardness (Hh) and the material hardness (Ho) is preferably 1 or more, more preferably 5 or more, and even more preferably 10 or more, and is preferably 70 or less, more preferably 65 or less, and even more preferably 60 or less in Shore D hardness. If the hardness difference (Hh−Ho) is 1 or more in Shore D hardness, the spin rate on driver shots is effectively lowered, and if the hardness difference (Hh−Ho) is 70 or less in Shore D hardness, the resilience of the golf ball is not lowered.

The tensile elastic modulus of the material forming the spherical center is preferably 15 MPa or more, more preferably 20 MPa or more, and is preferably 80 MPa or less, more preferably 60 MPa or less. The ratio (spherical center/lowest hardness envelope layer) of the tensile elastic modulus of the material forming the spherical center to the tensile elastic modulus of the material forming the lowest hardness envelope layer is preferably 1.2 or more, more preferably 1.5 or more, and is preferably 10 or less, more preferably 8 or less.

The hardness (Ha) of the material forming an envelope layer (Ea) adjacent to the inner side of the lowest hardness envelope layer (Es) and positioned between the spherical center and the lowest hardness envelope layer (Es) is preferably higher than the lowest hardness (Hs) and lower than the material hardness (Ho) (Hs<Ha<Ho). In addition, when another envelope layer (Eb) is disposed between the lowest hardness envelope layer (Es) and the highest hardness envelope layer (Eh), the hardness (Hb) of the material forming the envelope layer (Eb) is preferably higher than the lowest hardness (Hs) and lower than the highest hardness (Hh) (Hs<Hb<Hh).

The thickness of the envelope layer other than the lowest hardness envelope layer (Es) and the highest hardness envelope layer (Eh) is not particularly limited, and is preferably 0.1 mm or more, more preferably 0.2 mm or more, and even more preferably 0.3 mm or more, and is preferably 15 mm or less, more preferably 13 mm or less, and even more preferably 10 mm or less.

The diameter of the spherical center is preferably 5 mm or more, more preferably 7 mm or more, and even more preferably 10 mm or more, and is preferably 25 mm or less, more preferably 22 mm or less, and even more preferably 15 mm or less. If the diameter of the spherical center is 5 mm or more, the spin rate on driver shots is further lowered. On the other hand, if the diameter of the spherical center is 25 mm or less, the spin rate on approach shots is hardly lowered.

When the spherical center has a diameter in a range from 5 mm to 25 mm, the compression deformation amount (shrinking amount of the center along the compression direction) of the center when applying a load from 98 N as an initial load to 1275 N as a final load to the center is preferably 1.5 mm or more, more preferably 1.7 mm or more, and even more preferably 2.0 mm or more, and is preferably 5.0 mm or less, more preferably 4.7 mm or less, and even more preferably 4.5 mm or less. If the compression deformation amount is 1.5 mm or more, the shot feeling becomes better, while if the compression deformation amount is 5.0 mm or less, the resilience of the golf ball becomes better.

The spherical center preferably includes a region composed of the elements having a hitting deformation ratio of 30% or more. If the spherical center includes a region composed of the elements having a hitting deformation ratio of 30% or more, the resilience of the golf ball further increases.

The material hardness (Hc) of the cover is preferably 5 or more, more preferably 7 or more, and even more preferably 10 or more, and is preferably 55 or less, more preferably 53 or less, and even more preferably 50 or less in Shore D hardness. If the material hardness (Hc) of the cover falls within the above range, the spin rate on approach shots further increases.

The thickness of the cover is preferably 2.0 mm or less, more preferably 1.6 mm or less, even more preferably 1.2 mm or less, and particularly preferably 1.0 mm or less. If the thickness of the cover is 2.0 mm or less, the resilience and shot feeling of the obtained golf ball become better. The thickness of the cover is preferably 0.1 mm or more, more preferably 0.2 mm or more, and even more preferably 0.3 mm or more. If the thickness of the cover is less than 0.1 mm, molding the cover may become difficult, and the durability and wear resistance of the cover may deteriorate.

The multi-piece golf ball preferably has a diameter ranging from 40 mm to 45 mm. In light of satisfying the regulation of US Golf Association (USGA), the diameter is mostly preferably 42.67 mm or more. In light of prevention of air resistance, the diameter is more preferably 44 mm or less, and mostly preferably 42.80 mm or less. In addition, the multi-piece golf ball preferably has a mass of 40 g or more and 50 g or less. In light of obtaining greater inertia, the mass is more preferably 44 g or more, and mostly preferably 45.00 g or more. In light of satisfying the regulation of USGA, the mass is mostly preferably 45.93 g or less.

When the multi-piece golf ball has a diameter in a range from 40 mm to 45 mm, the compression deformation amount (shrinking amount along the compression direction) of the golf ball when applying a load from 98 N as an initial load to 1275 N as a final load to the golf ball is preferably 2.0 mm or more, more preferably 2.2 mm or more, and is preferably 4.0 mm or less, more preferably 3.5 mm or less. If the compression deformation amount is 2.0 mm or more, the golf ball does not become excessively hard, so the shot feeling thereof becomes better. On the other hand, if the compression deformation amount is 4.0 mm or less, the resilience of the golf ball becomes better.

Examples of the configuration of the multi-piece golf ball include: a configuration in which a first envelope layer covering the spherical center and a second envelope layer covering the first envelope layer include the region composed of the elements having the hitting deformation ratio of 30% or more; a configuration in which the spherical center, the first envelope layer, and the second envelope layer include the region composed of the elements having the hitting deformation ratio of 30% or more; a configuration in which the first envelope layer, the second envelope layer, and a third envelope layer covering the second envelope layer include the region composed of the elements having the hitting deformation ratio of 30% or more; and a configuration in which the spherical center, the first envelope layer, the second envelope layer, and the third envelope layer include the region composed of the elements having the hitting deformation ratio of 30% or more.

Among these configurations, the configuration in which the spherical center, the first envelope layer covering the spherical center, and the second envelope layer covering the first envelope layer include the region composed of the elements having the hitting deformation ratio of 30% or more, is more preferable. If the spherical center, the first envelope layer and the second envelope layer covering the spherical center include the region composed of the elements having the hitting deformation ratio of 30% or more, the golf ball can integrally deform when being hit, so that a golf ball having excellent resilience can be obtained.

(2) Golf Ball Constituent Material

The constituent materials constituting the golf ball according to the present invention will be described. Examples of the constituent materials constituting the golf ball according to the present invention include a thermoplastic resin composition and a rubber composition. The spherical center, envelope layer, and cover may be formed by using these materials. The material hardness of each material can be adjusted by changing the material formulation.

Thermoplastic Resin Composition

Firstly, the thermoplastic resin composition used in the present invention will be explained. (A) The resin component contained in the thermoplastic resin composition is not particularly limited, as long as it is a thermoplastic resin. Examples of the thermoplastic resin include, for example, a thermoplastic resin such as an ionomer resin, a thermoplastic olefin copolymer, a thermoplastic polyurethane resin, a thermoplastic polyamide resin, a thermoplastic styrene-based resin, a thermoplastic polyester resin, a thermoplastic acrylic resin, and the like. Among these thermoplastic resins, a thermoplastic elastomer having rubber elasticity is preferable. Examples of the thermoplastic elastomer include, for example, a thermoplastic polyurethane elastomer, a thermoplastic polyamide elastomer, a thermoplastic styrene-based elastomer, a thermoplastic polyester elastomer, a thermoplastic acrylic-based elastomer, and the like.

(2-1) Ionomer Resin

Examples of the ionomer resin include: an ionomer resin consisting of a metal ion-neutralized product of a binary copolymer composed of an olefin and an α,β-unsaturated carboxylic acid having 3 to 8 carbon atoms; an ionomer resin consisting of a metal ion-neutralized product of a ternary copolymer composed of an olefin, an α,β-unsaturated carboxylic acid having 3 to 8 carbon atoms and an α,β-unsaturated carboxylic acid ester; or a mixture thereof.

In the present invention, "the ionomer resin consisting of a metal ion-neutralized product of a binary copolymer composed of an olefin and an α,β-unsaturated carboxylic acid having 3 to 8 carbon atoms" is sometimes merely referred to as "the binary ionomer resin", and "the ionomer resin consisting of a metal ion-neutralized product of a ternary copolymer composed of an olefin, an α,β-unsaturated carboxylic acid having 3 to 8 carbon atoms and an α,β-unsaturated carboxylic acid ester" is sometimes merely referred to as "the ternary ionomer resin".

The olefin is preferably an olefin having 2 to 8 carbon atoms. Examples of the olefin include, for example, ethylene, propylene, butene, pentene, hexene, heptane and octane, and ethylene is particularly preferred. Examples of the α,β-unsaturated carboxylic acid having 3 to 8 carbon atoms include, for example, acrylic acid, methacrylic acid, fumaric acid, maleic acid and crotonic acid, and acrylic acid and methacrylic acid are particularly preferred. In addition, examples of the α,β-unsaturated carboxylic acid ester include, for example, methyl ester, ethyl ester, propyl ester, n-butyl ester, isobutyl ester of acrylic acid, methacrylic acid, fumaric acid and maleic acid, and acrylic acid ester and methacrylic acid ester are particularly preferred.

The binary ionomer resin is preferably a metal ion-neutralized product of a binary copolymer composed of ethylene-(meth)acrylic acid. The ternary ionomer resin is preferably a metal ion-neutralized product of a ternary copolymer composed of ethylene, (meth)acrylic acid and (meth)acrylic acid ester. Here, (meth)acrylic acid means acrylic acid and/or methacrylic acid.

The content of the α,β-unsaturated carboxylic acid component having 3 to 8 carbon atoms in the binary ionomer resin is preferably 15 mass % or more, more preferably 16 mass % or more, and even more preferably 17 mass % or more, and is preferably 30 mass % or less, more preferably 25 mass % or less. If the content of the α,β-unsaturated carboxylic acid component having 3 to 8 carbon atoms is 15 mass % or more, the resultant constituent member has a desirable hardness. If the content of the α,β-unsaturated carboxylic acid component having 3 to 8 carbon atoms is 30 mass % or less, since the hardness of the resultant constituent member does not become excessively high, the durability and the shot feeling thereof become better.

The degree of neutralization of the carboxyl groups of the binary ionomer resin is preferably 15 mole % or more, more preferably 20 mole % or more, and is preferably 100 mole % or less. If the degree of neutralization is 15 mole % or more, the resultant golf ball has better resilience and durability. The degree of neutralization of the carboxyl groups of the binary ionomer resin can be calculated by the following expression. Sometimes, the metal component is contained in such an amount that the theoretical degree of neutralization of the carboxyl groups contained in the ionomer resin exceeds 100 mole %.

Degree of neutralization (mole %) of the binary ionomer resin=100×the number of moles of carboxyl groups neutralized in the binary ionomer resin/the number of moles of all carboxyl groups contained in the binary ionomer resin Examples of the metal ion used for neutralizing at least a part of carboxyl groups of the binary ionomer resin include: a monovalent metal ion such as sodium, potassium, lithium; a divalent metal ion such as magnesium, calcium, zinc, barium, cadmium; a trivalent metal ion such as aluminum; and other ion such as tin, zirconium.

Specific examples of the binary ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn))" commercially available from Mitsui-Du Pont Polychemicals Co., Ltd.

Further, examples include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li))" commercially available from E.I. du Pont de Nemours and Company.

Further, examples include "Iotek (registered trademark) (e.g. Iotek 8000 (Na), Iotek 8030 (Na), Iotek 7010 (Zn), Iotek 7030 (Zn))" commercially available from ExxonMobil Chemical Corporation.

The binary ionomer resins may be used alone or as a mixture of at least two of them. It is noted that Na, Zn, Li and Mg described in the parentheses after the trade names indicate metal types of neutralizing metal ions of the binary ionomer resins.

The binary ionomer resin preferably has a bending stiffness of 140 MPa or more, more preferably 150 MPa or more, and even more preferably 160 MPa or more, and preferably has a bending stiffness of 550 MPa or less, more preferably 500 MPa or less, even more preferably 450 MPa or less. If the bending stiffness of the binary ionomer resin is excessively low, the flight distance tends to be shorter because of the increased spin rate of the golf ball. If the bending stiffness is excessively high, the durability of the golf ball may be lowered.

The binary ionomer resin preferably has a melt flow rate (190° C., 2.16 kgf) of 0.1 g/10 min or more, more preferably 0.5 g/10 min or more, even more preferably 1.0 g/10 min or more, and preferably has a melt flow rate (190° C., 2.16 kgf) of 30 g/10 min or less, more preferably 20 g/10 min or less, even more preferably 15 g/10 min or less. If the melt flow rate (190° C., 2.16 kgf) of the binary ionomer resin is 0.1 g/10 min or more, the thermoplastic resin composition has better fluidity, thus, for example, molding a thin layer becomes possible. If the melt flow rate (190° C., 2.16 kgf) of the binary ionomer resin is 30 g/10 min or less, the durability of the resultant golf ball becomes better.

The content of the α,β-unsaturated carboxylic acid component having 3 to 8 carbon atoms in the ternary ionomer resin is preferably 2 mass % or more, more preferably 3 mass % or more, and is preferably 30 mass % or less, more preferably 25 mass % or less.

The degree of neutralization of the carboxyl groups of the ternary ionomer resin is preferably 20 mole % or more, more preferably 30 mole % or more, and is preferably 100 mole % or less. If the degree of neutralization is 20 mole % or more, the resultant golf ball obtained by using the thermoplastic resin composition has better resilience and durability. The degree of neutralization of the carboxyl groups of the ionomer resin can be calculated by the following expression. Sometimes, the metal component is contained in such an amount that the theoretical degree of neutralization of the carboxyl groups of the ionomer resin exceeds 100 mole %.

Degree of neutralization (mole %) of the ionomer resin=100×the number of moles of carboxyl groups neutralized in the ionomer resin/the number of moles of all carboxyl groups contained in the ionomer resin Examples of the metal ion used for neutralizing at least a part of carboxyl groups of the ternary ionomer resin include: a monovalent metal ion such as sodium, potassium, lithium; a divalent metal ion such as magnesium, calcium, zinc, barium, cadmium; a trivalent metal ion such as aluminum; and other ion such as tin, zirconium.

Specific examples of the ternary ionomer resin include trade name "Himilan (e.g. Himilan AM7327 (Zn), Himilan 1855 (Zn), Himilan 1856 (Na), Himilan AM7331 (Na))" commercially available from Mitsui-Du Pont Polychemicals Co., Ltd. Further, the ternary ionomer resins commercially available from E.I. du Pont de Nemours and Company include "Surlyn 6320 (Mg), Surlyn 8120 (Na), Surlyn 8320 (Na), Surlyn 9320 (Zn), Surlyn 9320W (Zn), HPF1000 (Mg), HPF2000 (Mg) or the like". The ternary ionomer resins commercially available from ExxonMobil Chemical Corporation include "Iotek 7510 (Zn), Iotek 7520 (Zn) or the like". It is noted that Na, Zn and Mg described in the parentheses after the trade names indicate metal types of neutralizing metal ions. The ternary ionomer resins may be used alone or as a mixture of at least two of them.

The ternary ionomer resin preferably has a bending stiffness of 10 MPa or more, more preferably 11 MPa or more, even more preferably 12 MPa or more, and preferably has a bending stiffness of 100 MPa or less, more preferably 97 MPa or less, even more preferably 95 MPa or less. If the bending stiffness of the ternary ionomer resin is excessively low, the flight distance tends to be shorter because of the increased spin rate of the golf ball. If the bending stiffness is excessively high, the durability of the golf ball may be lowered.

The ternary ionomer resin preferably has a melt flow rate (190° C., 2.16 kgf) of 0.1 g/10 min or more, more preferably 0.3 g/10 min or more, even more preferably 0.5 g/10 min or more, and preferably has a melt flow rate (190° C., 2.16 kgf) of 20 g/10 min or less, more preferably 15 g/10 min or less, even more preferably 10 g/10 min or less. If the melt flow rate (190° C., 2.16 kgf) of the ternary ionomer resin is 0.1 g/10 min or more, the thermoplastic resin composition has better fluidity, thus it is easy to mold a thin envelope layer. If the melt flow rate (190° C., 2.16 kgf) of the ternary ionomer resin is 20 g/10 min or less, the durability of the resultant golf ball becomes better.

The ternary ionomer resin preferably has a slab hardness of 20 or more, more preferably 25 or more, even more preferably 30 or more, and preferably has a slab hardness of 70 or less, more preferably 65 or less, even more preferably 60 or less in Shore D hardness. If the ternary ionomer resin has a slab hardness of 20 or more in Shore D hardness, the resultant constituent member does not become excessively soft and thus the golf ball has better resilience. If the ternary ionomer resin has a slab hardness of 70 or less in Shore D hardness, the resultant constituent member does not become excessively hard and thus the golf ball has better durability.

(2-2) Thermoplastic Olefin Copolymer

Examples of the thermoplastic olefin copolymer include, for example, a binary copolymer composed of an olefin and an α,β-unsaturated carboxylic acid having 3 to 8 carbon atoms; a ternary copolymer composed of an olefin, an α,β-unsaturated carboxylic acid having 3 to 8 carbon atoms, and an α,β-unsaturated carboxylic acid ester; or a mixture thereof. The thermoplastic olefin copolymer is a nonionic copolymer in which the carboxyl groups are not neutralized.

In the present invention, "the binary copolymer composed of an olefin and an α,β-unsaturated carboxylic acid having 3 to 8 carbon atoms" is sometimes merely referred to as "the binary copolymer", and "the ternary copolymer composed of an olefin, an α,β-unsaturated carboxylic acid having 3 to 8 carbon atoms, and an α,β-unsaturated carboxylic acid ester" is sometimes merely referred to as "the ternary copolymer".

Examples of the olefin include the same as the olefin constituting the ionomer resin, and ethylene is particularly preferred. Examples of the α,β-unsaturated carboxylic acid having 3 to 8 carbon atoms and the ester include the same as the α,β-unsaturated carboxylic acid having 3 to 8 carbon atoms and the ester constituting the ionomer resin.

The binary copolymer is preferably a binary copolymer composed of ethylene and (meth)acrylic acid. The ternary copolymer is preferably a ternary copolymer composed of ethylene, (meth)acrylic acid, and (meth)acrylic acid ester. Here, (meth)acrylic acid means acrylic acid and/or methacrylic acid.

The content of the α,β-unsaturated carboxylic acid having 3 to 8 carbon atoms in the binary copolymer or the ternary copolymer is preferably 4 mass % or more, more preferably 5 mass % or more, and is preferably 30 mass % or less, more preferably 25 mass % or less.

The binary copolymer or the ternary copolymer preferably has a melt flow rate (190° C., 2.16 kgf) of 5 g/10 min or more, more preferably 10 g/10 min or more, even more preferably 15 g/10 min or more, and preferably has a melt flow rate (190° C., 2.16 kgf) of 1,700 g/10 min or less, more preferably 1,500 g/10 min or less, even more preferably 1,300 g/10 min or less. If the melt flow rate (190° C., 2.16 kgf) of the binary copolymer or the ternary copolymer is 5 g/10 min or more, the thermoplastic resin composition has better fluidity and thus it is easy to mold a constituent member. If the melt flow rate (190° C., 2.16 kgf) of the binary copolymer or the ternary copolymer is 1,700 g/10 min or less, the resultant golf ball has better durability.

Specific examples of the binary copolymer include: an ethylene-methacrylic acid copolymer having a trade name of "NUCREL (registered trademark) (e.g. "NUCREL N1050H", "NUCREL N2050H", "NUCREL N1110H", "NUCREL N0200H")" commercially available from Mitsui-Du Pont Polychemicals Co., Ltd; an ethylene-acrylic acid copolymer having a trade name of "PRIMACOR (registered trademark) 5980I" commercially available from Dow Chemical Company; and the like.

Specific examples of the ternary copolymer include: the ternary copolymer having a trade name of "NUCREL (e.g. "NUCREL AN4318", "NUCREL AN4319")" commercially available from Mitsui-Du Pont Polychemicals Co., Ltd; the ternary copolymer having a trade name of "NUCREL (e.g. "NUCREL AE")" commercially available from E.I. du Pont de Nemours and Company; the ternary copolymer having a trade name of "PRIMACOR (e.g. "PRIMACOR AT310", "PRIMACOR AT320")" commercially available from Dow Chemical Company; and the like. The binary copolymer or the ternary copolymer may be used alone or as a mixture of at least two of them.

(2-3) Thermoplastic Polyurethane Resin and Thermoplastic Polyurethane Elastomer

Examples of the thermoplastic polyurethane resin and the thermoplastic polyurethane elastomer include a thermoplastic resin and a thermoplastic elastomer which have plurality of urethane bonds in the main molecular chain. The polyurethane is preferably a product obtained by a reaction between a polyisocyanate component and a polyol component. Examples of the thermoplastic polyurethane elastomer include, for example, trade names of "Elastollan (registered trademark) XNY85A", "Elastollan XNY90A", "Elastollan XNY97A", "Elastollan ET885", and "Elastollan ET890" manufactured by BASF Japan Ltd and the like.

(2-4) Thermoplastic Styrene-Based Elastomer

A thermoplastic elastomer containing a styrene block can be appropriately used as the thermoplastic styrene-based elastomer. The thermoplastic elastomer containing a styrene block has a polystyrene block which is a hard segment, and a soft segment. Typical soft segment is a diene block. Examples of a constituent component of the diene block include butadiene, isoprene, 1,3-pentadiene and 2,3-dimethyl-1,3-butadiene. Butadiene and isoprene are preferable. Two or more constituent components may be used in combination.

The thermoplastic elastomer containing a styrene block includes: a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, even more preferably 15 mass % or more. In the view of the shot feeling of the resultant golf ball, the content is preferably 50 mass % or less, more preferably 47 mass % or less, even more preferably 45 mass % or less.

The thermoplastic elastomer containing a styrene block includes an alloy of one kind or two or more kinds selected from the group consisting of SBS, SIS, SIBS, SEBS, SEPS, SEEPS and a hydrogenated product thereof with a polyolefin. It is presumed that the olefin component in the alloy contributes to the improvement in compatibility with the ionomer resin. By using the alloy, the resilience of the golf ball is increased. An olefin having 2 to 10 carbon atoms is preferably used. Appropriate examples of the olefin include ethylene, propylene, butane and pentene. Ethylene and propylene are particularly preferred.

Specific examples of the polymer alloy include the polymer alloys having trade names of "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N" and "Rabalon SR04" manufactured by Mitsubishi Chemical Corporation. Other specific examples of the thermoplastic elastomer containing a styrene block include "Epofriend A1010" manufactured by Daicel Chemical Industries, Ltd and "Septon HG-252" manufactured by Kuraray Co., Ltd.

(2-5) Thermoplastic Polyamide Resin and Thermoplastic Polyamide Elastomer

The thermoplastic polyamide is not particularly limited, as long as it is a thermoplastic resin having plurality of amide bonds (—NH—CO—) in the main molecular chain. Examples of the thermoplastic polyamide include, for example, a product having an amide bond in the molecule formed by a ring-opening polymerization of lactam or a reaction between a diamine component and a dicarboxylic acid component.

Examples of the polyamide resin include, for example, an aliphatic polyamide such as polyamide 6, polyamide 11, polyamide 12, polyamide 66, polyamide 610, polyamide 6T, polyamide 61, polyamide 9T, polyamide MST, polyamide 612; and an aromatic polyamide such as poly-p-phenyleneterephthalamide, poly-m-phenyleneisophthalamide. These polyamides may be used alone or in combination of at least two of them. Among them, the aliphatic polyamide such as polyamide 6, polyamide 66, polyamide 11, polyamide 12 is preferable.

Specific examples of the polyamide resin include, for example, the polyamide resin having a trade name of "Rilsan (registered trademark) B (e.g. Rilsan BESN TL, Rilsan BESN P20 TL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 D and the like)" commercially available from Arkema Inc., and the like.

The polyamide elastomer has a hard segment part consisting of a polyamide component and a soft segment part. Examples of the soft segment part of the polyamide elastomer include, for example, a polyether ester component or a polyether component. Examples of the polyamide elastomer include, for example, a polyether ester amide obtained by a reaction between a polyamide component (hard segment component) and a polyether ester component (soft segment component) consisting of polyoxyalkylene glycol and dicarboxylic acid; and a polyether amide obtained by a reaction between a polyamide component (hard segment component) and a polyether (soft segment component) consisting of a product obtained by aminating or carboxylating two terminal ends of polyoxyalkylene glycol and dicarboxylic acid or diamine.

Examples of the polyamide elastomer include, for example, "PEBAX (registered trademark) 2533", "PEBAX 3533", "PEBAX 4033", "PEBAX 5533" manufactured by Arkema Inc. and the like.

(2-6) Thermoplastic Polyester Resin and Thermoplastic Polyester Elastomer

The thermoplastic polyester resin is not particularly limited, as long as it is a thermoplastic resin having plurality of ester bonds in the main molecular chain. For example, a product obtained by a reaction between dicarboxylic acid and diol is preferable. Examples of the thermoplastic polyester elastomer include, for example, a block copolymer having a hard segment consisting of a polyester component and a soft segment. Examples of the polyester component constituting the hard segment include, for example, an aromatic polyester. Examples of the soft segment component include an aliphatic polyether, an aliphatic polyester and the like.

Specific examples of the polyester elastomer include "Hytrel (registered trademark) 3548", "Hytrel 4047" manufactured by Toray-Du Pont Co., Ltd; "Primalloy (registered trademark) A1606", "Primalloy B1600", "Primalloy B1700" manufactured by Mitsubishi Chemical Corporation; and the like.

(2-7) Thermoplastic (Meth)Acrylic-Based Elastomer

Examples of the thermoplastic (meth)acrylic-based elastomer include a thermoplastic elastomer obtained by copolymerizing ethylene and (meth)acrylic acid ester. Specific examples of the thermoplastic (meth)acrylic-based elastomer include, for example, "Kurarity (a block copolymer of methyl methacrylate and butyl acrylate)" manufactured by Kuraray Co., Ltd.

The thermoplastic resin composition preferably contains, as the resin component, at least one kind selected from the group consisting of the ionomer resin, the thermoplastic olefin copolymer, the thermoplastic styrene-based elastomer, the thermoplastic polyester elastomer, the thermoplastic polyurethane elastomer, the thermoplastic polyamide elastomer, and the thermoplastic acrylic-based elastomer. This is because a constituent member having a desired hardness can be formed easily.

In the present invention, when the ionomer resin or the thermoplastic olefin copolymer are used as the resin component contained in the thermoplastic resin composition, the thermoplastic resin composition may further contain (B) a basic metal salt of a fatty acid which will be explained below. By containing (B) the basic metal salt of the fatty acid, the degree of neutralization of the ionomer resin and the thermoplastic olefin copolymer can be increased. By increasing the degree of neutralization, the resilience of the resultant constituent member becomes higher.

(B) The basic metal salt of the fatty acid is obtained by a well-known producing method where a fatty acid is allowed to react with a metal oxide or metal hydroxide. The conventional metal salt of the fatty acid is obtained by a reaction of the fatty acid with the metal oxide or metal hydroxide in an amount of the reaction equivalent, whereas (B) the basic metal salt of the fatty acid is obtained by adding the metal oxide or metal hydroxide in an excessive amount which is larger than the reaction equivalent to the fatty acid, and the resultant product has a different metal content, melting point or the like from the conventional metal salt of the fatty acid.

As (B) the basic metal salt of the fatty acid, a basic metal salt of a fatty acid represented by the following general formula (1) is preferred.

$$mM^1O.M^2(RCOO)_2 \quad (1)$$

In the formula (1), m represents the number of moles of metal oxides or metal hydroxides in the basic metal salt of the fatty acid. The m preferably ranges from 0.1 to 2.0. Herein, m is preferably 0.5 or more, more preferably 0.7 or more, more preferably 0.9 or more, and is preferably 1.8 or less, more preferably 1.5 or less. If m is less than 0.1, the resilience of the obtained resin composition may be lowered, while if m exceeds 2.0, the melting point of the basic metal salt of the fatty acid becomes so high that it may be difficult to disperse to the resin component. $M^1$ and $M^2$ are preferably the group II or the group XII metals of the periodic table, respectively. $M^1$ and $M^2$ may be identical or different from each other. Examples of the group II metals include beryllium, magnesium, calcium, strontium and barium. Examples of the group XII metals include zinc, cadmium and mercury. Preferred is, for example, magnesium, calcium, barium or zinc, and more preferred is magnesium, as $M^1$ and $M^2$ metals.

In the formula (1), RCOO means the residue of the saturated fatty acid or unsaturated fatty acid. Specific examples of the saturated fatty acid component of (B) the basic metal salt of the fatty acid (IUPAC name) include butanoic acid (C4), pentanoic acid (C5), hexanoic acid (C6), heptanoic acid (C7), octanoic acid (C8), nonanoic acid (C9), decanoic acid (C10), undecanoic acid (C11), dodecanoic acid (C12), tridecanoic acid (C13), tetradecanoic acid (C14), pentadecanoic acid (C15), hexadecanoic acid (C16), heptadecanoic acid (C17), octadecanoic acid (C18), nonadecanoic acid (C19), icosanoic acid (C20), heneicosanoic acid (C21), docosanoic acid (C22), tricosanoic acid (C23), tetracosanoic acid (024), pentacosanoic acid (C25), hexacosanoic acid (C26), heptacosanoic acid (C27), octacosanoic acid (C28), nonacosanoic acid (C29), and triacontanoic acid (C30).

Specific examples of the unsaturated fatty acid component of (B) the basic metal salt of the fatty acid (IUPAC name) include butenoic acid (C4), pentenoic acid (C5), hexenoic acid (C6), heptenoic acid (C7), octenoic acid (C8), nonenoic acid (C9), decenoic acid (C10), undecenoic acid (C11), dodecenoic acid (C12), tridecenoic acid (C13), tetradecenoic acid (C14), pentadecenoic acid (C15), hexadecenoic acid (C16), heptadecenoic acid (C17), octadecenoic acid (C18), nonadecenoic acid (C19), icosenoic acid (C20), heneicosenoic acid (C21), docosenoic acid (C22), tricosenoic acid (C23), tetracosenoic acid (C24), pentacosenoic acid (C25), hexacosenoic acid (C26), heptacosenoic acid (C27), octacosenoic acid (C28), nonacosenoic acid (C29), and triacontenoic acid (C30).

Specific examples of the fatty acid component of (B) the basic metal salt of the fatty acid (Common name) are, for example, butyric acid (C4), valeric acid (C5), caproic acid (C6), enanthic acid (C7), caprylic acid (C8), pelargonic acid (C9), capric acid (C10), lauric acid (C12), myristic acid (C14), myristoleic acid (C14), pentadecylic acid (C15), palmitic acid (C16), palmitoleic acid (C16), margaric acid (C17), stearic acid (C18), elaidic acid (C18), vaccenic acid (C18), oleic acid (C18), linoleic acid (C18), linolenic acid (C18), 12-hydroxy stearic acid (C18), arachidic acid (C20), gadoleic acid (C20), arachidonic acid (C20), eicosenoic acid (C20), behenic acid (C22), erucic acid (C22), lignoceric acid (C24), nervonic acid (C24), cerotic acid (C26), montanic acid (C28), and melissic acid (C30).

(B) The basic metal salt of the fatty acid is preferably a basic metal salt of an unsaturated fatty acid. The unsaturated fatty acid component preferably includes at least one selected from the group consisting of oleic acid (C18), erucic acid (C22), linoleic acid (C18), linolenic acid (C18), arachidonic acid (C20), eicosapentaenoic acid (C20), docosahexaenoic acid (C22), stearidonic acid (C18), nervonic acid (C24), vaccenic acid (C18), gadoleic acid (C20), elaidic acid (C18), eicosenoic acid (C20), eicosadienoic acid (C20), docosadienoic acid (C22), pinolenic acid (C18), eleostearic acid (C18), mead acid (C20), adrenic acid (C22), clupanodonic acid (C22), nisinic acid (C24), and tetracosapentaenoic acid (C24).

(B) The basic metal salt of the fatty acid is preferably a basic metal salt of a fatty acid having 8 to 30 carbon atoms, and more preferably a basic metal salt of a fatty acid having 12 to 24 carbon atoms. Specific examples of (B) the basic metal salt of the fatty acid include basic magnesium laurate, basic calcium laurate, basic zinc laurate, basic magnesium myristate, basic calcium myristate, basic zinc myristate, basic magnesium palmitate, basic calcium palmitate, basic zinc palmitate, basic magnesium oleate, basic calcium oleate, basic zinc oleate, basic magnesium stearate, basic calcium stearate, basic zinc stearate, basic magnesium 12-hydroxystearate, basic calcium 12-hydroxystearate, basic zinc 12-hydroxystearate, basic magnesium behenate, basic calcium behenate, and basic zinc behenate. (B) The basic metal salt of the fatty acid preferably includes a basic magnesium salt of a fatty acid, and more preferably basic magnesium stearate, basic magnesium behenate, basic magnesium laurate, and basic magnesium oleate. (B) The basic metal salt of the fatty acid may be used alone or as a mixture of at least two of them.

There is no particular limitation on the melting point of (B) the basic metal salt of the fatty acid, but if the metal is magnesium, the melting point is preferably 100° C. or more, and is preferably 300° C. or less, more preferably 290° C. or less, even more preferably 280° C. or less. If the melting point falls within the above range, the dispersibility to the resin component becomes better.

(B) The basic metal salt of the fatty acid preferably contains the metal component in an amount of 1 mole % or more, more preferably 1.1 mole % or more, and preferably contains the metal component in an amount of 2 mole % or less, more preferably 1.9 mole % or less. If the content of the metal component falls within the above range, the resilience of the obtained golf ball's constituent member is further increased. The content of the metal component of (B) the basic metal salt of the fatty acid is a value calculated by dividing the metal amount (g) contained per 1 mole of the metal salt by the atomic weight of the metal, and is expressed in mole %.

The content of (B) the basic metal salt of the fatty acid in the thermoplastic resin composition used in the present invention is preferably 5 parts by mass or more, more preferably 8 parts by mass or more, even more preferably 10 parts by mass or more, and is preferably 100 parts by mass or less, more preferably 90 parts by mass or less, with respect to 100 parts by mass of (A) the resin component. If the content of (B) the basic metal salt of the fatty acid is 5 parts by mass or more, the resilience of the golf ball's constituent member is increased, while if the content is 100 parts by mass or less, it is possible to suppress the lowering of the durability of the golf ball's constituent member due to the increase in the low-molecular weight component.

In the inventive golf ball comprising a spherical center, three or more envelope layers covering the spherical center, and a cover covering the envelope layers, examples of the resin component constituting the center or the envelope layers preferably include the ionomer resin, the thermoplastic olefin copolymer, the thermoplastic styrene-based elastomer and the mixture thereof. As the resin component, a resin component containing the thermoplastic styrene-based elastomer is preferable. Examples of the thermoplastic styrene-based elastomer preferably include the alloy of one kind or two or more kinds selected from the group consisting of SBS, SIS, SIBS, SEBS, SEPS, SEEPS and the hydrogenated product thereof with the polyolefin. The content of the thermoplastic styrene-based elastomer in the resin component constituting the center is preferably 5 mass % or more, more preferably 10 mass % or more, and is preferably 100 mass % or less, more preferably 80 mass % or less.

Examples of the preferable embodiment of the resin component constituting the spherical center or the envelope layers include the following embodiments.

(1) An embodiment containing the ionomer resin and the thermoplastic styrene-based elastomer as the resin component. In a more preferable embodiment, the ternary ionomer resin and the alloy of one kind or two or more kinds selected from the group consisting of SBS, SIS, SIBS, SEBS, SEPS, SEEPS and the hydrogenated product thereof with the polyolefin are contained.

(2) An embodiment containing the ionomer resin and the thermoplastic styrene-based elastomer, and further containing the basic metal salt of the fatty acid for increasing the degree of neutralization of the ionomer resin. In a more preferable embodiment, the ternary ionomer resin, the alloy of one kind or two or more kinds selected from the group consisting of SBS, SIS, SIBS, SEBS, SEPS, SEEPS and the hydrogenated product thereof with the polyolefin, and further the basic metal salt of the fatty acid for increasing the degree of neutralization of the ionomer resin are contained.

(3) An embodiment containing the thermoplastic olefin copolymer and the thermoplastic styrene-based elastomer, and further containing the basic metal salt of the fatty acid for increasing the degree of neutralization of the thermoplastic olefin copolymer. Examples of the thermoplastic olefin copolymer preferably include the binary copolymer composed of the olefin and the α,β-unsaturated carboxylic acid having 3 to 8 carbon atoms and/or the ternary copolymer composed of the olefin, the α,β-unsaturated carboxylic acid having 3 to 8 carbon atoms and the α,β-unsaturated carboxylic acid ester. Examples of the thermoplastic styrene-based elastomer preferably include the alloy of one kind or two or more kinds selected from the group consisting of SBS, SIS, SIBS, SEBS, SEPS, SEEPS and the hydrogenated product thereof with the polyolefin.

The resin component constituting the lowest hardness envelope layer (Es) preferably contains an ionomer resin and a thermoplastic styrene-based elastomer. A total amount of these resin components is preferably 50 mass % or more, more preferably 70 mass % or more, and even more preferably 90 mass % or more. In this case, a mass ratio of the ionomer resin to the thermoplastic styrene-based elastomer (ionomer resin/thermoplastic styrene-based elastomer) is preferably 0.1 or more, more preferably 0.2 or more, and even more preferably 0.3 or more, and is preferably 3.0 or less, more preferably 1.7 or less, and even more preferably 1.2 or less.

The resin component constituting the highest hardness envelope layer (Eh) preferably contains an ionomer resin. The content of the ionomer resin is preferably 50 mass % or more, more preferably 70 mass % or more, and even more preferably 90 mass % or more.

The resin component constituting the cover preferably contains an ionomer resin, a thermoplastic polyurethane resin (including a thermoplastic polyurethane elastomer), or a mixture thereof. If the resin component constituting the cover contains the ionomer resin, the golf ball showing excellent durability and travelling a long distance can be obtained. If the resin component constituting the cover contains the thermoplastic polyurethane resin (including a thermoplastic polyurethane elastomer), the golf ball showing excellent shot feeling and controllability can be obtained.

The resin component constituting the cover preferably contains a thermoplastic polyurethane resin. The content of the thermoplastic polyurethane resin is preferably 50 mass % or more, more preferably 70 mass % or more, and even more preferably 90 mass % or more.

The thermoplastic resin composition used in the present invention may further contain (C) an additive. Examples of (C) the additive include a pigment component such as a white pigment (for example, titanium oxide), a blue pigment or the like; a weight adjusting agent; a dispersant; an antioxidant; an ultraviolet absorber; a light stabilizer; a fluorescent material; a fluorescent brightener; or the like. Examples of the weight adjusting agent include inorganic fillers such as zinc oxide, barium sulfate, calcium carbonate, magnesium oxide, tungsten powder, molybdenum powder, and the like.

The content of the white pigment (for example, titanium oxide), with respect to 100 parts by mass of (A) the resin component, is preferably 0.5 part by mass or more, more preferably 1 part by mass or more, and is preferably 10 parts by mass or less, more preferably 8 parts by mass or less. If the content of the white pigment is 0.5 part by mass or more, it is possible to impart the opacity to the golf ball's constituent member. If the content of the white pigment is more than 10 parts by mass, the durability of the obtained golf ball's constituent member may deteriorate.

The thermoplastic resin composition used in the present invention can be obtained, for example, by dry blending (A) the resin component and (C) the additive. (B) The basic metal salt of the fatty acid is dry blended where necessary. Further, the dry blended mixture may be extruded into a pellet form. The dry blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single screw extruder.

Rubber Composition

Next, the rubber composition which can be used in the present invention will be explained. Examples of the rubber composition include a composition containing a base rubber, a crosslinking initiator, a co-crosslinking agent, and a filler.

As the base rubber, a natural rubber and/or a synthetic rubber may be used. Examples of the base rubber include a polybutadiene rubber, a natural rubber, a polyisoprene rubber, a styrene polybutadiene rubber, and an ethylene-propylene-diene rubber (EPDM). These rubbers can be used solely or as a combination of two or more kinds. Among them, particularly preferred is a high cis-polybutadiene having cis-1,4-bond which is beneficial to resilience in a content of 40 mass % or more, more preferably 80 mass % or more, even more preferably 90 mass % or more.

The high cis-polybutadiene preferably has 1,2-vinyl bond in a content of 2 mass % or less, more preferably 1.7 mass % or less, and even more preferably 1.5 mass % or less. If the content of 1,2-vinyl bond is excessively high, the resilience may be lowered.

The high cis-polybutadiene preferably includes a product synthesized by using a rare-earth element catalyst. When a neodymium catalyst employing a neodymium compound which is a lanthanum series rare-earth element compound, is used, a polybutadiene rubber having a high content of cis-1,4 bond and a low content of 1,2-vinyl bond can be obtained with excellent polymerization activity, thus such a polybutadiene rubber is particularly preferred.

The high cis-polybutadiene preferably has a Mooney viscosity ($ML_{1+4}$ (100° C.)) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor rotation time of 4 minutes; and a temperature of 100° C.

The high cis-polybutadiene preferably has a molecular weight distribution Mw/Mn (Mw: weight average molecular weight, Mn: number average molecular weight) of 2.0 or more, more preferably 2.2 or more, even more preferably 2.4 or more, most preferably 2.6 or more, and preferably has a molecular weight distribution Mw/Mn of 6.0 or less, more preferably 5.0 or less, even more preferably 4.0 or less, most preferably 3.4 or less. If the molecular weight distribution (Mw/Mn) of the high cis-polybutadiene is excessively low, the processability may deteriorate. If the molecular weight distribution (Mw/Mn) of the high cis-polybutadiene is excessively high, the resilience may be lowered. It is noted that the molecular weight distribution is measured by gel permeation chromatography ("HLC-8120GPC" manufactured by Tosoh Corporation) using a differential refractometer as a detector under the conditions of column: GMH-HXL (manufactured by Tosoh Corporation), column temperature: 40° C., and mobile phase: tetrahydrofuran, and calculated by converting based on polystyrene standard.

The crosslinking initiator is blended to crosslink the base rubber component. As the crosslinking initiator, an organic peroxide is preferably used. Specific examples of the organic peroxide are dicumyl peroxide, 1,1-bis(t-butylperoxy)-3,3,5-trimethylcyclohexane, 2,5-dimethyl-2,5-di(t-butylperoxy) hexane, and di-t-butyl peroxide. Among them, dicumyl peroxide is preferably used. The blending amount of the crosslinking initiator is preferably 0.3 part by mass or more, more preferably 0.4 part by mass or more, and is preferably 5 parts by mass or less, more preferably 3 parts by mass or less, with respect to 100 parts by mass of the base rubber. If the amount is less than 0.3 part by mass, the resultant envelope layer becomes so soft that the resilience tends to be lowered, and if the amount is more than 5 parts by mass, the amount of the co-crosslinking agent must be decreased to obtain an appropriate hardness, which tends to cause the insufficient resilience.

The co-crosslinking agent is considered to have an action of crosslinking a rubber molecule by graft polymerization to a base rubber molecular chain. As the co-crosslinking agent, for example, an α,β-unsaturated carboxylic acid having 3 to 8 carbon atoms or a metal salt thereof can be used, examples thereof preferably include acrylic acid, methacrylic acid and a metal salt thereof. Examples of the metal constituting the metal salt include, for example, zinc, magnesium, calcium, aluminum and sodium, among them, zinc is preferably used because it provides high resilience.

The amount of the co-crosslinking agent to be used is preferably 10 parts by mass or more, more preferably 15 parts by mass or more, even more preferably 20 parts by mass or more, and is preferably 55 parts by mass or less, more preferably 50 parts by mass or less, even more preferably 48 parts by mass or less, with respect to 100 parts by mass of the base rubber. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the resultant envelope layer becomes so hard that the shot feeling may be lowered.

The filler contained in the rubber composition is mainly blended as a weight adjusting agent in order to adjust the weight of the golf ball obtained as a final product, and may be blended where necessary. Examples of the filler include an inorganic filler such as zinc oxide, barium sulfate, calcium carbonate, magnesium oxide, tungsten powder, and molybdenum powder. The blending amount of the filler is preferably 0.5 part by mass or more, more preferably 1 part by mass or more, and is preferably 30 parts by mass or less, more preferably 20 parts by mass or less, with respect to 100 parts by mass of the base rubber. If the blending amount of the filler is less than 0.5 part by mass, it becomes difficult to adjust the weight, while if it is more than 30 parts by mass, the weight fraction of the rubber component becomes small and the resilience tends to be lowered.

An organic sulfur compound, an antioxidant, a peptizing agent or the like may be blended appropriately in the rubber composition, in addition to the base rubber, the crosslinking initiator, the co-crosslinking agent and the filler.

Examples of the organic sulfur compound include thiophenols, thionaphthols, polysulfides, thiocarboxylic acids, dithiocarboxylic acids, sulfenamindes, thiurams, dithiocarbamates, thiazoles, and the like. Among them, diphenyl disulfides may be preferably used as the organic sulfur compound. Examples of the diphenyl disulfides include diphenyl disulfide; a mono-substituted diphenyl disulfide such as bis(4-chlorophenyl)disulfide, bis(3-chlorophenyl) disulfide, bis(4-bromophenyl)disulfide, bis(3-bromophenyl) disulfide, bis(4-fluorophenyl)disulfide, bis(4-iodophenyl) disulfide, bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl) disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide; a tri-substituted diphenyl disulfide such as bis(2,4,5-trichlorophenyl)disulfide, bis(2,4,6-trichlorophenyl)disulfide, bis(2-cyano-4-chloro-6-bromophenyl)disulfide; a tetra-substituted diphenyl disulfide such as bis(2,3,5,6-tetra chlorophenyl) disulfide; a penta-substituted diphenyl disulfide such as bis(2,3,4,5,6-pentachlorophenyl)disulfide, bis(2,3,4,5,6-pentabromophenyl)disulfide. These diphenyl disulfides can enhance resilience by having some influence on the state of vulcanization of vulcanized rubber. Among them, diphenyl disulfide or bis (pentabromophenyl) disulfide is preferably used since the golf ball having particularly high resilience can be obtained. The blending amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber.

The blending amount of the antioxidant is preferably 0.1 part by mass or more and 1 part by mass or less with respect to 100 parts by mass of the base rubber. Further, the blending amount of the peptizing agent is preferably 0.1 part by mass or more and 5 parts by mass or less with respect to 100 parts by mass of the base rubber.

The raw materials are mixed and kneaded, and the resultant rubber composition is molded into the envelope layer in a mold. Examples of the method for molding the rubber composition into the envelope layer include, without particular limitation, a method comprising the steps of: molding the rubber composition into a half shell having a hemispherical shape beforehand, covering the spherical body with two half shells, and compression molding at 130° C. to 170° C. for 5 minutes to 30 minutes; and a method of injection molding the rubber composition.

Examples of the construction of the golf ball according to present invention include: a five-piece golf ball comprising a spherical center, three envelope layers covering the spherical center, and a cover covering the envelope layers; a six-piece golf ball comprising a spherical center, four envelope layers covering the spherical center, and a cover covering the envelope layers; and a seven-piece golf ball comprising a spherical center, five envelope layers covering the spherical center, and a cover covering the envelope layers; and the like.

Examples of the constituent material combination of the golf ball include: an embodiment in which the spherical center and the lowest hardness envelope layer (Es) are formed from a thermoplastic resin composition; an embodiment in which the spherical center and the lowest hardness envelope layer (Es) are formed from a rubber composition; an embodiment in which the spherical center is formed from a thermoplastic resin composition, and the lowest hardness envelope layer (Es) is formed from a rubber composition; an embodiment in which the spherical center is formed from a rubber composition, and the lowest hardness envelope layer (Es) is formed from a thermoplastic resin composition; and the like. It is preferable that the highest hardness envelope layer (Eh) is formed from a thermoplastic resin composition.

Figure 9:
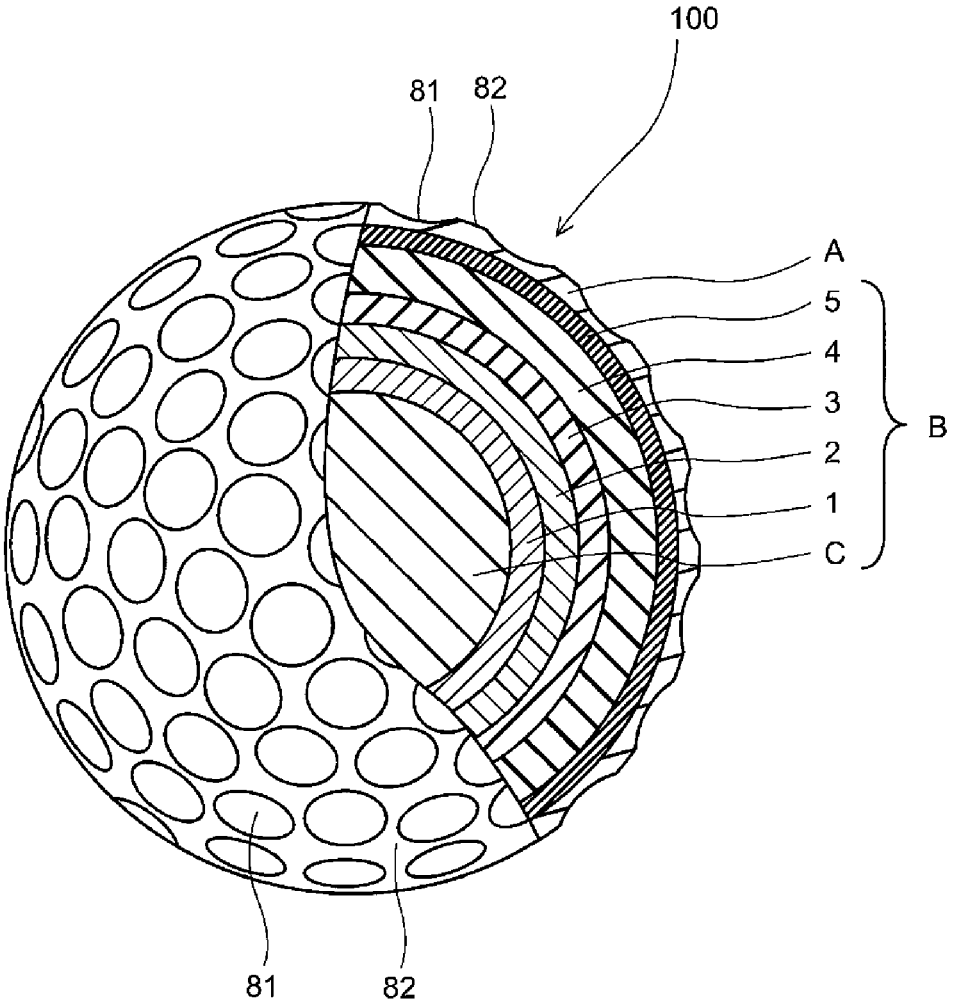
FIG. 9 is a partially cutaway cross-sectional view of a golf ball 100 according to an embodiment of the present invention.

FIG. 9 is a partially cutaway sectional view of a golf ball 100 of one embodiment according to the present invention. The golf ball 100 comprises a spherical center C, a first envelope layer 1 disposed on the outer side of the spherical center C, a second envelope layer 2 disposed on the outer side of the first envelope layer 1, a third envelope layer 3 disposed on the outer side of the second envelope layer 2, a fourth envelope layer 4 disposed on the outer side of the third envelope layer 3, a fifth envelope layer 5 disposed on the outer side of the fourth envelope layer 4, and a cover A disposed on the outer side of the fifth envelope layer 5. The core B is composed of the spherical center C, the first envelop layer 1, the second envelop layer 2, the third envelop layer 3, the fourth envelop layer, and the fifth envelop layer 5. A plurality of dimples 81 are formed on the surface of the cover A. Other portions than dimples 81 on the surface of the cover A are land 82. In the case of a seven-piece golf ball, it is preferred that the second envelope layer is the lowest hardness envelope layer (Es), and the fifth envelope layer is the highest hardness envelope layer (Eh).

(3) Method for Producing Golf Ball

Next, the method for producing the golf ball according to the present invention will be described based on a golf ball embodiment comprising a spherical center, envelope layers cover the spherical center and a cover covering the envelope layers. However, the method for producing the golf ball according to the present invention is not limited by the production method shown below.

Spherical Center

The thermoplastic resin composition or the rubber composition can be used as the spherical center constituent material. In the case that the spherical center is formed from the thermoplastic resin composition, the center can be obtained, for example, by injection molding the thermoplastic resin composition. Specifically, it is preferred that the thermoplastic resin composition heated and melted at a temperature of 160° C. to 260° C. is charged into a mold held under a pressure of 1 MPa to 100 MPa for 1 second to 100 seconds, and after cooling for 30 second to 300 seconds, the mold is opened.

In the case that the spherical center is formed from the rubber composition, the center can be obtained by molding the kneaded rubber composition in a mold. The temperature for molding the spherical center is preferably 120° C. to 170° C. The molding pressure is preferably 2.9 MPa to 11.8 MPa, and the molding time is preferably 10 minutes to 60 minutes.

Envelope Layer

The thermoplastic resin composition or the rubber composition can be used as the envelope layer constituent material. In the case that the envelope layer is formed from the thermoplastic resin composition, the envelope layer can be obtained, for example, by a method of molding the thermoplastic resin composition into a half shell having a hemispherical shape beforehand, covering the spherical body with two half shells, and compression molding at 130° C. to 170° C. for 1 minute to 5 minutes, or by a method of directly injection molding the thermoplastic resin composition onto the spherical body to cover the center therein.

When injection molding the thermoplastic resin composition onto the spherical body to mold the envelope layer, it is preferred to use upper and lower molds having a hemispherical cavity and a hold pin. Injection molding of the envelope layer can be carried out by protruding the hold pin, placing the spherical body to be covered, holding the spherical body with the hold pin, charging the heated and melted thermoplastic resin composition and then cooling to obtain the envelope layer.

When molding the envelope layer by compression molding method, the half shell can be molded by either compression molding method or injection molding method, but compression molding method is preferred. Compression molding the thermoplastic resin composition into the half shell can be carried out, for example, under a pressure of 1 MPa or more and 20 MPa or less at a molding temperature of −20° C. or more and 70° C. or less relative to the flow beginning temperature of the thermoplastic resin composition. By carrying out the molding under the above conditions, the half shell with a uniform thickness can be formed. Examples of the method for molding the envelope layer with half shells include a method of covering the spherical body with two half shells and then performing compression molding. Compression molding the half shells into the envelope layer can be carried out, for example, under a molding pressure of 0.5 MPa or more and 25 MPa or less at a molding temperature of −20° C. or more and 70° C. or less relative to the flow beginning temperature of the thermoplastic resin composition. By carrying out the molding under the above conditions, the envelope layer with a uniform thickness can be formed.

The molding temperature means the highest temperature where the temperature at the surface of the concave portion of the lower mold reaches from closing the mold to opening the mold. Further, the flow beginning temperature of the thermoplastic resin composition can be measured in a pellet form under the following conditions by using "Flow Tester CFT-500" manufactured by Shimadzu Corporation.

Measuring conditions: Plunger Area: 1 $cm^2$, Die length: 1 mm, Die diameter: 1 mm, Load: 588.399 N, Start temperature: 30° C., and Temperature increase rate: 3° C./min.

When the envelope layer is formed from the rubber composition, the envelope layer can be obtained, for example, by a method of molding the rubber composition into a half shell having a hemispherical shape beforehand, covering the spherical body with two half shells, and compression molding at 130° C. to 170° C. for 5 minutes to 30 minutes. The envelope layer may also be formed by injection molding the rubber composition.

Cover

The thermoplastic resin composition can be used as the cover constituent material. As the method of molding the thermoplastic resin composition into the cover, the above-described method of molding the thermoplastic resin composition into the envelope layer can be adopted. It is preferred to use upper and lower molds having a hemispherical cavity and pimples wherein a part of the pimple also serves as a retractable hold pin.

The concave portions called "dimple" are usually formed on the surface of the cover. The total number of dimples formed on the cover is preferably 200 or more and 500 or less. If the total number of dimples is less than 200, the dimple effect is hardly obtained. On the other hand, if the total number of dimples exceeds 500, the dimple effect is hardly obtained because the size of the respective dimple is small. The shape (shape in a plan view) of dimples includes, without limitation, a circle; a polygonal shape such as a roughly triangular shape, a roughly quadrangular shape, a roughly pentagonal shape, a roughly hexagonal shape; or other irregular shape. The shape of dimples is employed solely or in combination of at least two of them.

After the cover is molded, the obtained golf ball body is ejected from the mold, and is preferably subjected to surface treatments such as deburring, cleaning and sandblast where necessary. If desired, a paint film or a mark may be formed. The paint film preferably has a thickness of, but not limited to, 5 μm or larger, and more preferably 7 μm or larger, and preferably has a thickness of 50 μm or smaller, more preferably 40 μm or smaller, even more preferably 30 μm or smaller. If the thickness of the paint film is smaller than 5 μm, the paint film is easy to wear off due to continued use of the golf ball, and if the thickness of the paint film is larger than 50 μm, the dimple effect is reduced, resulting in lowering flying performance of the golf ball.

EXAMPLES

Hereinafter, the present invention will be described in detail by way of example. The present invention is not limited to examples described below. Various changes and modifications can be made without departing from the spirit and scope of the present invention.

(1) Material Hardness (Shore D Hardness)

The material hardness of each layer was measured as follows. In case of the thermoplastic resin composition, sheets with a thickness of about 2 mm were produced by injection molding, and in case of the rubber composition, sheets with a thickness of about 2 mm were produced by compressing at 170° C. for 25 minutes. These sheets were stored at 23° C. for two weeks. Three or more of these sheets were stacked on one another so as not to be affected by the measuring substrate on which the sheets were placed, and the hardness of the stack was measured with a type P1 auto loading durometer manufactured by Kobunshi Keiki Co., Ltd., provided with a Shore D type spring hardness tester prescribed in ASTM-D2240. It is noted that the material hardness of the spherical center is represented by H0, the material hardness of the first envelope layer is represented by H1, the material hardness of the second envelope layer is represented by H2, the material hardness of the third envelope layer is represented by H3, the material hardness of the fourth envelope layer is represented by H4, the material hardness of the fifth envelope layer is represented by H5, and the material hardness of the cover is represented by Hc.

to prepare the thermoplastic resin composition in a pellet form. Extrusion was performed in the following conditions: screw diameter: 45 mm, screw revolutions: 200 rpm; and screw L/D=35. The blending materials were heated to a temperature in a range from 160° C. to 230° C. at the die position of the extruder.

TABLE 3

| | | Thermoplastic resin composition No. | | | | | | | | | | |
|---|---|---|---|---|---|---|---|---|---|---|---|---|
| | | a | b | c | d | e | f | g | h | i | k | l |
| Formulation (parts by mass) | Himilan AM7327 | — | — | 50 | — | — | — | — | — | — | — | — |
| | Nucrel AN4319 | — | — | — | 40 | — | — | — | — | — | — | — |
| | Himilan 1605 | — | — | — | — | — | — | — | — | — | 50 | — |
| | Himilan AM7329 | — | — | — | — | — | — | — | — | — | 50 | — |
| | HPF2000 | 100 | — | — | — | 75 | 60 | 50 | 25 | — | — | — |
| | HPF1000 | — | 100 | — | — | — | — | — | — | — | — | — |
| | Rabalon T3221C | — | — | 50 | 60 | 25 | 40 | 50 | 75 | 100 | — | — |
| | Elastollan XNY84A | — | — | — | — | — | — | — | — | — | — | 100 |
| | Basic Mg oleate | — | — | 15 | 28 | — | — | — | — | — | — | — |
| | Titanium dioxide | — | — | — | — | — | — | — | — | — | 4 | 4 |
| Tensile elastic modulus (MPa) | | 58.8 | 114.1 | 16.8 | 13.0 | 28.4 | 19.5 | 15.1 | 7.4 | 3.7 | 226.2 | 19.0 |
| Shore D hardness | | 45 | 54 | 27 | 23 | 35 | 29 | 25 | 15 | 5 | 65 | 32 |
| Ionomer resin/Styrene-based elastomer | | — | — | 1.0 | 0.7 | 3.0 | 1.5 | 1.0 | 0.3 | — | — | — |

(2) Compression Deformation Amount (mm)

The compression deformation amount of the golf ball along the compression direction (shrinking amount of the golf ball along the compression direction), when applying a load from 98 N as an initial load to 1275 N as a final load to the golf ball, was measured.

(3) Tensile Elastic Modulus (MPa)

In the case of a thermoplastic resin composition, a sheet with a thickness of about 2 mm was prepared by injection molding. In the case of a rubber composition, a sheet with a thickness of about 2 mm was prepared by pressing at 170° C. for 25 minutes. The obtained sheets were stored at 23° C. for two weeks. Then, a test piece with a dumbbell shape was prepared from the sheet, and the tensile elastic modulus of the test piece was measured according to ISO 527-1.

(4) Spin Rate on Approach Shots

A sand wedge (CG15 forged wedge (58°), manufactured by Cleveland Golf) was installed on a swing machine manufactured by True Temper Sports, Inc. The golf ball was hit at a head speed of 10 m/sec, and the spin rate (rpm) was measured by taking a sequence of photographs of the hit golf ball. This measurement was conducted ten times for each golf ball, and the average value thereof was adopted as the spin rate.

(5) Spin Rate (rpm) on Driver Shots

A metal-headed W#1 driver (XXIO S, loft: 11°, manufactured by Dunlop Sports Limited) was installed on a swing robot M/C manufactured by Golf Laboratories, Inc. The golf ball was hit at a head speed of 50 m/sec, and the spin rate right after hitting the golf ball was measured. This measurement was conducted twelve times for each golf ball, and the average value thereof was adopted as the measurement value for the golf ball. A sequence of photographs of the hit golf ball were taken for measuring the spin rate right after hitting the golf ball.

[Production of Golf Ball]

(1) Preparation of Thermoplastic Resin Composition

As shown in Table 3, the blending materials were dry blended, followed by mixing with a twin-screw kneading extruder to extrude the blended material in a strand form into the cool water. The extruded strand was cut with a pelletizer The materials used in Table 3 are as follows.

Himilan AM7327: zinc ion-neutralized ethylene-methacrylic acid-butyl acrylate ternary copolymer ionomer resin (melt flow rate (190° C., 2.16 kgf): 0.7 g/10 min, bending stiffness: 35 MPa) manufactured by Mitsui-Du Pont Polychemicals Co., Ltd.

Nucrel AN4319: ethylene-methacrylic acid-butyl acrylate copolymer (melt flow rate (190° C., 2.16 kgf): 55 g/10 min, bending stiffness: 21 MPa) manufactured by Mitsui-Du Pont Polychemicals Co., Ltd.

Himilan 1605: sodium ion-neutralized ethylene-methacrylic acid copolymer ionomer resin (melt flow rate (190° C., 2.16 kgf): 2.8 g/10 min, bending stiffness: 320 MPa) manufactured by Mitsui-Du Pont Polychemicals Co., Ltd.

Himilan AM7329: zinc ion-neutralized ethylene-methacrylic acid copolymer ionomer resin (melt flow rate (190° C., 2.16 kgf): 5 g/10 min, bending stiffness: 221 MPa) manufactured by Mitsui-Du Pont Polychemicals Co., Ltd.

HPF2000: magnesium ion-neutralized ternary copolymer ionomer resin (melt flow rate (190° C., 2.16 kgf): 1.0 g/10 min, bending stiffness: 64 MPa) manufactured by E.I. du Pont de Nemours and Company HPF1000: magnesium ion-neutralized ternary copolymer ionomer resin (melt flow rate (190° C., 2.16 kgf): 0.7 g/10 min, bending stiffness: 190 MPa) manufactured by E.I. du Pont de Nemours and Company Rabalon T3221C: thermoplastic styrene elastomer (alloy of one kind or two or more kinds selected from the group consisting of SBS, SIS, SIBS, SEBS, SEPS, SEEPS and a hydrogenated product thereof with a polyolefin) manufactured by Mitsubishi Chemical Corporation Elastollan XNY84A: thermoplastic polyurethane elastomer manufactured by BASF Japan Ltd.

Basic Mg oleate: (m=0.7 in the formula (1), $M^1=M^2=Mg$, R=17 carbon atoms) manufactured by Nitto kasei Kougyo Co., Ltd.

Titanium dioxide: A220 manufactured by Ishihara Sangyo Co., Ltd.

(2) Preparation of Rubber Composition

The materials shown in Table 4 were mixed and kneaded to prepare the rubber composition.

TABLE 4

| Rubber composition No. | | A | B | C | D | E |
|---|---|---|---|---|---|---|
| Formulation (parts by mass) | Polybutadiene rubber | 100 | 100 | 100 | 100 | 100 |
| | Zinc acrylate | 18 | 37 | 10 | 5 | 20 |
| | Zinc oxide | 5 | 5 | 5 | 5 | 5 |
| | Diphenyl disulfide | 0.5 | — | 0.5 | 0.5 | 0.5 |
| | Bis(pentabromophenyl) disulfide | — | 0.3 | — | — | — |
| | Dicumyl peroxide | 0.7 | 0.9 | 0.7 | 0.7 | 0.7 |
| | Barium sulfate | Appropriate amount | Appropriate amount | Appropriate amount | Appropriate amount | Appropriate amount |
| Tensile elastic modulus (MPa) | | 16.3 | 126.2 | 9.2 | 4.5 | 42.5 |
| Shore D hardness | | 34 | 58 | 27 | 19 | 45 |

The materials used in Table 4 are as follows.

Polybutadiene rubber: "BR-730 (high-cis polybutadiene, cis-1,4 bond content=96 mass %, 1,2-vinyl bond content=1.3 mass %, Moony viscosity ($ML_{1+4}$ (100° C.)=55, molecular weight distribution (Mw/Mn)=3)" manufactured by JSR Corporation Zinc acrylate: "ZNDA-90S" manufactured by Nihon Jyoryu Kogyo Co., Ltd.

Zinc oxide: "Ginrei (registered trademark) R" manufactured by Toho Zinc Co., Ltd.

Diphenyl disulfide: manufactured by Sumitomo Seika Chemicals Co., Ltd.

Dicumyl peroxide: "Percumyl (registered trademark) D" manufactured by NOF Corporation Barium sulfate: "Barium Sulfate BD" manufactured by Sakai Chemical Industry Co., Ltd.

(3) Production of Spherical Center

The thermoplastic resin compositions obtained above were injection molded at 200° C. as shown in Tables 5 and 7 to produce the spherical centers. In addition, the rubber compositions obtained above were pressed at 170° C. for 25 minutes as shown in Tables 6, and 8 to produce the spherical centers. For the golf ball No. 5-1, the rubber composition No. A shown in Table 4 was pressed at 170° C. for 25 minutes to produce the spherical center.

(4) Production of Envelope Layer from Thermoplastic Resin Composition

The thermoplastic resin compositions obtained above were injection molded at 200° C. as shown in Tables 5 to 8 to mold each of the envelope layers.

(5) Production of Envelope Layer from Rubber Composition

The rubber compositions shown in Table 4 were molded into half shells as shown in Tables 6 and 7, and the spherical body was covered with two of the half shells. The spherical body and the half shells were charged together into a mold consisting of upper and lower molds which have a hemispherical cavity, and then heated at 170° C. for 25 minutes to produce the envelope layer from the rubber composition. For the golf ball No. 5-1, the rubber composition No. B shown in Table 4 was used to form the two-layered core from the rubber compositions.

(6) Production of Cover from Thermoplastic Resin Composition

The cover was formed by compression molding the thermoplastic resin composition obtained above. The obtained thermoplastic resin composition in a pellet form was charged one by one into each concave portion of the lower mold of the mold which is used for molding the half shell, and compression was performed to form the half shell. The compression molding was conducted at the molding temperature of 160° C., the molding time of 2 minutes, and the molding pressure of 11 MPa. The spherical body on which the envelope layers had been formed was concentrically covered with two of the half shells, then charged into the mold having a plurality of pimples on one surface of the cavity thereof, and compression molded to form the cover. The compression molding was conducted at the molding temperature of 150° C., the molding time of 3 minutes and the molding pressure of 13 MPa. A plurality of dimples having a reversed shape of the pimple shape were formed on the molded cover.

The surface of the obtained golf ball body was treated with sandblast, marked, and painted with a clear paint. The paint was dried in an oven at 40° C. to obtain the golf ball having a diameter of 42.8 mm and a mass of 45.4 g. Evaluation results of the obtained golf balls were shown in Tables 5 to 8.

TABLE 5

| Golf ball No. | | 1-1 | 1-2 | 1-3 | 1-4 | 1-5 | 1-6 | 1-7 | 1-8 |
|---|---|---|---|---|---|---|---|---|---|
| Center | Material No. | e | e | e | a | c | e | f | f |
| | Central point hardness H0 (Shore D) | 35 | 35 | 35 | 45 | 27 | 35 | 29 | 29 |
| | Diameter (mm) | 15 | 15 | 15 | 15 | 15 | 15 | 15 | 20 |
| | Radius cumulation (%) | 35.0 | 35.0 | 35.0 | 35.0 | 35.0 | 35.0 | 35.0 | 46.7 |
| First envelope layer | Material No. | f | f | g | f | g | f | a | a |
| | Hardness H1 (Shore D) | 29 | 29 | 25 | 29 | 25 | 29 | 45 | 45 |
| | Content (%) of elements having a hitting deformation ratio of 30% or more | 10.2 | 10.2 | 10.2 | 10.2 | 10.2 | 10.2 | 10.2 | 37 |
| | Thickness (mm) | 2.5 | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 46.7 | 58.4 |
| Second envelope layer | Material No. | h | h | h | h | h | h | g | d |
| | Hardness H2 (Shore D) | 15 | 15 | 15 | 15 | 15 | 15 | 25 | 23 |
| | Content (%) of elements having a hitting deformation ratio of 30% or more | 37 | 37 | 37 | 37 | 37 | 37 | 37 | 52.8 |
| | Thickness (mm) | 2.5 | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 58.4 | 70.1 |

TABLE 5-continued

| | | | | | | | | | |
|---|---|---|---|---|---|---|---|---|---|
| Third envelope layer | Material No. | a | a | a | a | a | a | a | a |
| | Hardness H3 (Shore D) | 45 | 45 | 45 | 45 | 45 | 45 | 45 | 45 |
| | Content (%) of elements having a hitting deformation ratio of 30% or more | 52.8 | 52.8 | 52.8 | 52.8 | 52.8 | 52.8 | 52.8 | 0 |
| | Thickness (mm) | 2.5 | 5.0 | 2.5 | 2.5 | 2.5 | 5.0 | 5.0 | 2.5 |
| | Radius cumulation (%) | 70.1 | 81.8 | 70.1 | 70.1 | 70.1 | 81.8 | 81.8 | 81.8 |
| Fourth envelope layer | Material No. | b | b | b | b | b | b | b | b |
| | Hardness H4 (Shore D) | 54 | 54 | 54 | 54 | 54 | 54 | 54 | 54 |
| | Content (%) of elements having a hitting deformation ratio of 30% or more | 0 | 0 | 0 | 0 | 0 | 0 | 0 | 0 |
| | Thickness (mm) | 4.9 | 2.4 | 4.9 | 4.9 | 4.9 | 2.4 | 2.4 | 2.4 |
| | Radius cumulation (%) | 93.0 | 93.0 | 93.0 | 93.0 | 93.0 | 93.0 | 93.0 | 93.0 |
| Fifth envelope layer | Material No. | k | k | k | k | k | k | k | k |
| | Hardness H5 (Shore D) | 65 | 65 | 65 | 65 | 65 | 65 | 65 | 65 |
| | Content (%) of elements having a hitting deformation ratio of 30% or more | 0 | 0 | 0 | 0 | 0 | 0 | 0 | 0 |
| | Thickness (mm) | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 |
| Cover | Material No. | l | l | l | l | l | l | l | l |
| | Hardness Hc (Shore D) | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 |
| Hardness difference (Hh − Ho) | | 30 | 30 | 30 | 20 | 38 | 30 | 36 | 36 |
| Properties | Compression deformation amount (mm) | 2.72 | 2.80 | 2.73 | 2.70 | 2.75 | 2.82 | 2.80 | 2.83 |
| | Spin rate on driver shots Sd (rpm) | 2371 | 2367 | 2316 | 2445 | 2246 | 2312 | 2582 | 2428 |
| | Spin rate on approach shots Sa10(rpm) | 3799 | 3749 | 3802 | 3801 | 3801 | 3751 | 3712 | 3512 |
| | Sd/Sa10 | 0.62 | 0.63 | 0.61 | 0.64 | 0.59 | 0.62 | 0.70 | 0.69 |

| | Golf ball No. | 1-9 | 1-10 | 1-11 | 1-12 | 1-13 | 1-14 | 1-15 | 1-16 |
|---|---|---|---|---|---|---|---|---|---|
| Center | Material No. | f | f | c | g | f | f | a | f |
| | Central point hardness H0 (Shore D) | 29 | 29 | 27 | 25 | 29 | 29 | 45 | 29 |
| | Diameter (mm) | 15 | 20 | 15 | 15 | 20 | 15 | 15 | 15 |
| | Radius cumulation (%) | 35.0 | 46.7 | 35.0 | 35.0 | 46.7 | 35.0 | 35.0 | 35.0 |
| First envelope layer | Material No. | a | a | a | a | a | a | g | g |
| | Hardness H1 (Shore D) | 45 | 45 | 45 | 45 | 45 | 45 | 25 | 25 |
| | Content (%) of elements having a hitting deformation ratio of 30% or more | 10.2 | 37 | 10.2 | 10.2 | 89.8 | 10.2 | 10.2 | 10.2 |
| | Thickness (mm) | 2.5 | 2.5 | 2.5 | 2.5 | 5.0 | 2.5 | 2.5 | 2.5 |
| | Radius cumulation (%) | 46.7 | 58.4 | 46.7 | 46.7 | 70.1 | 46.7 | 46.7 | 46.7 |
| Second envelope layer | Material No. | h | h | i | h | g | a | a | a |
| | Hardness H2 (Shore D) | 15 | 15 | 5 | 15 | 25 | 45 | 45 | 45 |
| | Content (%) of elements having a hitting deformation ratio of 30% or more | 37 | 52.8 | 37 | 37 | 0 | 89.8 | 89.8 | 89.8 |
| | Thickness (mm) | 2.5 | 2.5 | 2.5 | 2.5 | 2.5 | 7.5 | 7.5 | 7.5 |
| | Radius cumulation (%) | 58.4 | 70.1 | 58.4 | 58.4 | 81.8 | 81.8 | 81.8 | 81.8 |
| Third envelope layer | Material No. | a | a | a | a | — | — | — | — |
| | Hardness H3 (Shore D) | 45 | 45 | 45 | 45 | — | — | — | — |
| | Content (%) of elements having a hitting deformation ratio of 30% or more | 52.8 | 0 | 52.8 | 52.8 | — | — | — | — |
| | Thickness (mm) | 5.0 | 2.5 | 5.0 | 5.0 | — | — | — | — |
| | Radius cumulation (%) | 81.8 | 81.8 | 81.8 | 81.8 | — | — | — | — |
| Fourth envelope layer | Material No. | b | b | b | b | b | b | b | g |
| | Hardness H4 (Shore D) | 54 | 54 | 54 | 54 | 54 | 54 | 54 | 25 |
| | Content (%) of elements having a hitting deformation ratio of 30% or more | 0 | 0 | 0 | 0 | 0 | 0 | 0 | 0 |
| | Thickness (mm) | 2.4 | 2.4 | 2.4 | 2.4 | 2.4 | 2.4 | 2.4 | 2.4 |
| | Radius cumulation (%) | 93.0 | 93.0 | 93.0 | 93.0 | 93.0 | 93.0 | 93.0 | 93.0 |
| Fifth envelope layer | Material No. | k | k | k | k | k | k | k | k |
| | Hardness H5 (Shore D) | 65 | 65 | 65 | 65 | 65 | 65 | 65 | 65 |
| | Content (%) of elements having a hitting deformation ratio of 30% or more | 0 | 0 | 0 | 0 | 0 | 0 | 0 | 0 |
| | Thickness (mm) | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 |
| Cover | Material No. | l | l | l | l | l | l | l | l |
| | Hardness Hc (Shore D) | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 |
| Hardness difference (Hh − Ho) | | 36 | 36 | 38 | 40 | 36 | 36 | 20 | 36 |
| Properties | Compression deformation amount (mm) | 2.86 | 2.90 | 2.79 | 2.84 | 2.82 | 2.64 | 2.45 | 2.95 |
| | Spin rate on driver shots Sd (rpm) | 2478 | 2382 | 2389 | 2469 | 2573 | 2755 | 2708 | 2573 |
| | Spin rate on approach shots Sa10(rpm) | 3739 | 3465 | 3701 | 3739 | 3523 | 3667 | 3678 | 3675 |
| | Sd/Sa10 | 0.66 | 0.69 | 0.65 | 0.66 | 0.73 | 0.75 | 0.74 | 0.70 |

TABLE 6

| | Golf ball No. | 2-1 | 2-2 | 2-3 | 2-4 | 2-5 | 2-6 | 2-7 | 2-8 | 2-9 | 2-10 | 2-11 |
|---|---|---|---|---|---|---|---|---|---|---|---|---|
| Center | Material No. | A | A | A | E | A | A | A | A | A | A | A |
| | Central point hardness H0 (Shore D) | 34 | 34 | 34 | 45 | 34 | 34 | 34 | 34 | 34 | 34 | 34 |
| | Diameter (mm) | 15 | 15 | 15 | 15 | 15 | 15 | 15 | 20 | 15 | 15 | 15 |
| | Radius cumulation (%) | 35.0 | 35.0 | 35.0 | 35.0 | 35.0 | 35.0 | 35.0 | 46.7 | 35.0 | 35.0 | 35.0 |
| First envelope layer | Material No. | f | f | g | g | f | a | a | a | a | g | g |
| | Hardness H1 (Shore D) | 29 | 29 | 25 | 25 | 29 | 45 | 45 | 45 | 45 | 25 | 25 |
| | Content (%) of elements having a hitting deformation ratio of 30% or more | 10.2 | 10.2 | 10.2 | 10.2 | 10.2 | 10.2 | 10.2 | 89.8 | 10.2 | 10.2 | 10.2 |
| | Thickness (mm) | 2.5 | 2.5 | 2.5 | 2.5 | 2.5 | 2.5 | 2.5 | 5.0 | 2.5 | 2.5 | 2.5 |
| | Radius cumulation (%) | 46.7 | 46.7 | 46.7 | 46.7 | 46.7 | 46.7 | 46.7 | 70.1 | 46.7 | 46.7 | 46.7 |
| Second envelope layer | Material No. | C | C | D | D | C | C | D | C | E | E | E |
| | Hardness H2 (Shore D) | 27 | 27 | 19 | 19 | 27 | 27 | 19 | 27 | 45 | 45 | 45 |
| | Content (%) of elements having a hitting deformation ratio of 30% or more | 37 | 37 | 37 | 37 | 37 | 37 | 37 | 0 | 89.8 | 89.8 | 89.8 |
| | Thickness (mm) | 2.5 | 2.5 | 2.5 | 2.5 | 2.5 | 2.5 | 2.5 | 2.5 | 7.5 | 7.5 | 7.5 |
| | Radius cumulation (%) | 58.4 | 58.4 | 58.4 | 58.4 | 58.4 | 58.4 | 58.4 | 81.8 | 81.8 | 81.8 | 81.8 |
| Third envelope layer | Material No. | a | a | a | a | a | a | a | — | — | — | — |
| | Hardness H3 (Shore D) | 45 | 45 | 45 | 45 | 45 | 45 | 45 | — | — | — | — |
| | Content (%) of elements having a hitting deformation ratio of 30% or more | 52.8 | 52.8 | 52.8 | 52.8 | 52.8 | 52.8 | 52.8 | — | — | — | — |
| | Thickness (mm) | 2.5 | 5.0 | 2.5 | 5.0 | 5.0 | 5.0 | 5.0 | — | — | — | — |
| | Radius cumulation (%) | 70.1 | 81.8 | 70.1 | 81.8 | 81.8 | 81.8 | 81.8 | — | — | — | — |
| Fourth envelope layer | Material No. | b | b | b | b | b | b | b | b | b | b | g |
| | Hardness H4 (Shore D) | 54 | 54 | 54 | 54 | 54 | 54 | 54 | 54 | 54 | 54 | 25 |
| | Content (%) of elements having a hitting deformation ratio of 30% or more | 0 | 0 | 0 | 0 | 0 | 0 | 0 | 0 | 0 | 0 | 0 |
| | Thickness (mm) | 4.9 | 2.4 | 4.9 | 2.4 | 2.4 | 2.4 | 2.4 | 2.4 | 2.4 | 2.4 | 2.4 |
| | Radius cumulation (%) | 93.0 | 93.0 | 93.0 | 93.0 | 93.0 | 93.0 | 93.0 | 93.0 | 93.0 | 93.0 | 93.0 |
| Fifth envelope layer | Material No. | k | k | k | k | k | k | k | k | k | k | k |
| | Hardness H5 (Shore D) | 65 | 65 | 65 | 65 | 65 | 65 | 65 | 65 | 65 | 65 | 65 |
| | Content (%) of elements having a hitting deformation ratio of 30% or more | 0 | 0 | 0 | 0 | 0 | 0 | 0 | 0 | 0 | 0 | 0 |
| | Thickness (mm) | 1.0 | 1.0 | 1.0 | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 | 97.7 | 97.7 | 97.7 |
| Cover | Material No. | l | l | l | l | l | l | l | l | l | l | l |
| | Hardness Hc (Shore D) | 32 | 32 | 32 | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 | 0.5 | 0.5 | 0.5 |
| Hardness difference (Hh − Ho) | | 31 | 31 | 31 | 31 | 31 | 31 | 31 | 31 | 31 | 31 | 31 |
| Properties | Compression deformation amount (mm) | 2.71 | 2.80 | 2.73 | 2.71 | 2.81 | 2.76 | 2.79 | 3.04 | 2.76 | 2.78 | 2.81 |
| | Spin rate on driver shots Sd (rpm) | 2377 | 2373 | 2322 | 2357 | 2318 | 2545 | 2503 | 2695 | 2718 | 2536 | 2536 |
| | Spin rate on approach shots Sa10(rpm) | 3797 | 3746 | 3799 | 3800 | 3749 | 3738 | 3749 | 3438 | 3596 | 3604 | 3604 |
| | Sd/Sa10 | 0.63 | 0.63 | 0.61 | 0.62 | 0.62 | 0.68 | 0.67 | 0.78 | 0.76 | 0.70 | 0.70 |

TABLE 7

| | Golf ball No. | 3-1 | 3-2 | 3-3 | 3-4 | 3-5 | 3-6 | 3-7 | 3-8 | 3-9 | 3-10 | 3-11 |
|---|---|---|---|---|---|---|---|---|---|---|---|---|
| Center | Material No. | e | e | e | c | e | f | f | f | g | a | f |
| | Central point hardness H0 (Shore D) | 35 | 35 | 35 | 27 | 35 | 29 | 29 | 29 | 25 | 45 | 29 |
| | Diameter (mm) | 15 | 15 | 15 | 15 | 15 | 15 | 15 | 20 | 15 | 15 | 15 |
| | Radius cumulation (%) | 35.0 | 35.0 | 35.0 | 35.0 | 35.0 | 35.0 | 35.0 | 46.7 | 35.0 | 35.0 | 35.0 |
| First envelope layer | Material No. | f | f | g | g | f | a | a | a | a | g | g |
| | Hardness H1 (Shore D) | 29 | 29 | 25 | 25 | 29 | 45 | 45 | 45 | 45 | 25 | 25 |
| | Content (%) of elements having a hitting deformation ratio of 30% or more | 10.2 | 10.2 | 10.2 | 10.2 | 10.2 | 10.2 | 10.2 | 89.8 | 10.2 | 10.2 | 10.2 |
| | Thickness (mm) | 2.5 | 2.5 | 2.5 | 2.5 | 2.5 | 2.5 | 2.5 | 5.0 | 2.5 | 2.5 | 2.5 |
| | Radius cumulation (%) | 46.7 | 46.7 | 46.7 | 46.7 | 46.7 | 46.7 | 46.7 | 70.1 | 46.7 | 46.7 | 46.7 |
| Second envelope layer | Material No. | C | C | D | D | C | C | D | C | E | E | E |
| | Hardness H2 (Shore D) | 27 | 27 | 19 | 19 | 27 | 27 | 19 | 27 | 45 | 45 | 45 |
| | Content (%) of elements having a hitting deformation ratio of 30% or more | 37 | 37 | 37 | 37 | 37 | 37 | 37 | 0 | 89.8 | 89.8 | 89.8 |
| | Thickness (mm) | 2.5 | 2.5 | 2.5 | 2.5 | 2.5 | 2.5 | 2.5 | 2.5 | 7.5 | 7.5 | 7.5 |
| | Radius cumulation (%) | 58.4 | 58.4 | 58.4 | 58.4 | 58.4 | 58.4 | 58.4 | 81.8 | 81.8 | 81.8 | 81.8 |

TABLE 7-continued

| | Golf ball No. | 3-1 | 3-2 | 3-3 | 3-4 | 3-5 | 3-6 | 3-7 | 3-8 | 3-9 | 3-10 | 3-11 |
|---|---|---|---|---|---|---|---|---|---|---|---|---|
| Third envelope layer | Material No. | a | a | a | a | a | a | a | — | — | — | — |
| | Hardness H3 (Shore D) | 45 | 45 | 45 | 45 | 45 | 45 | 45 | — | — | — | — |
| | Content (%) of elements having a hitting deformation ratio of 30% or more | 52.8 | 52.8 | 52.8 | 52.8 | 52.8 | 52.8 | 52.8 | — | — | — | — |
| | Thickness (mm) | 2.5 | 5.0 | 2.5 | 5.0 | 5.0 | 5.0 | 5.0 | — | — | — | — |
| | Radius cumulation (%) | 70.1 | 81.8 | 70.1 | 81.8 | 81.8 | 81.8 | 81.8 | — | — | — | — |
| Fourth envelope layer | Material No. | b | b | b | b | b | b | b | b | b | b | g |
| | Hardness H4 (Shore D) | 54 | 54 | 54 | 54 | 54 | 54 | 54 | 54 | 54 | 54 | 25 |
| | Content (%) of elements having a hitting deformation ratio of 30% or more | 0 | 0 | 0 | 0 | 0 | 0 | 0 | 0 | 0 | 0 | 0 |
| | Thickness (mm) | 4.9 | 2.4 | 4.9 | 2.4 | 2.4 | 2.4 | 2.4 | 2.4 | 2.4 | 2.4 | 2.4 |
| | Radius cumulation (%) | 93.0 | 93.0 | 93.0 | 93.0 | 93.0 | 93.0 | 93.0 | 93.0 | 93.0 | 93.0 | 93.0 |
| Fifth envelope layer | Material No. | k | k | k | k | k | k | k | k | k | k | k |
| | Hardness H5 (Shore D) | 65 | 65 | 65 | 65 | 65 | 65 | 65 | 65 | 65 | 65 | 65 |
| | Content (%) of elements having a hitting deformation ratio of 30% or more | 0 | 0 | 0 | 0 | 0 | 0 | 0 | 0 | 0 | 0 | 0 |
| | Thickness (mm) | 1.0 | 1.0 | 1.0 | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 | 97.7 | 97.7 | 97.7 |
| Cover | Material No. | l | l | l | l | l | l | l | l | l | l | l |
| | Hardness Hc (Shore D) | 32 | 32 | 32 | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 | 0.5 | 0.5 | 0.5 |
| Hardness difference (Hh − Ho) | | 30 | 30 | 30 | 38 | 30 | 36 | 36 | 36 | 40 | 20 | 36 |
| Properties | Compression deformation amount (mm) | 2.71 | 2.80 | 2.73 | 2.71 | 2.81 | 2.76 | 2.79 | 3.04 | 2.76 | 2.78 | 2.81 |
| | Spin rate on driver shots Sd (rpm) | 2382 | 2378 | 2326 | 2400 | 2322 | 2488 | 2446 | 2566 | 2653 | 2614 | 2479 |
| | Spin rate on approach shots Sa10(rpm) | 3797 | 3746 | 3799 | 3801 | 3749 | 3737 | 3748 | 3590 | 3595 | 3606 | 3558 |
| | Sd/Sa10 | 0.63 | 0.63 | 0.61 | 0.63 | 0.62 | 0.67 | 0.65 | 0.71 | 0.74 | 0.73 | 0.70 |

TABLE 8

| | Golf ball No. | 4-1 | 4-2 | 4-3 | 4-4 | 4-5 | 4-6 | 4-7 |
|---|---|---|---|---|---|---|---|---|
| Center | Material No. | A | A | A | A | A | A | A |
| | Central point hardness H0 (Shore D) | 34 | 34 | 34 | 34 | 34 | 34 | 34 |
| | Diameter (mm) | 15 | 15 | 15 | 15 | 15 | 15 | 20 |
| | Radius cumulation (%) | 35.0 | 35.0 | 35.0 | 35.0 | 35.0 | 35.0 | 46.7 |
| First envelope layer | Material No. | f | f | g | f | g | a | a |
| | Hardness H1 (Shore D) | 29 | 29 | 25 | 29 | 25 | 45 | 45 |
| | Content (%) of elements having a hitting deformation ratio of 30% or more | 10.2 | 10.2 | 10.2 | 10.2 | 10.2 | 10.2 | 37.0 |
| | Thickness (mm) | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 58.4 |
| Second envelope layer | Material No. | h | h | h | h | h | g | d |
| | Hardness H2 (Shore D) | 15 | 15 | 15 | 15 | 15 | 25 | 23 |
| | Content (%) of elements having a hitting deformation ratio of 30% or more | 37 | 37 | 37 | 37 | 37 | 37 | 52.8 |
| | Thickness (mm) | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 70.1 |
| Third envelope layer | Material No. | a | a | a | a | a | a | a |
| | Hardness H3 (Shore D) | 45 | 45 | 45 | 45 | 45 | 45 | 45 |
| | Content (%) of elements having a hitting deformation ratio of 30% or more | 52.8 | 52.8 | 52.8 | 52.8 | 52.8 | 52.8 | 0 |
| | Thickness (mm) | 2.5 | 5.0 | 2.5 | 2.5 | 5.0 | 5.0 | 2.5 |
| | Radius cumulation (%) | 70.1 | 81.8 | 70.1 | 70.1 | 81.8 | 81.8 | 81.8 |
| Fourth envelope layer | Material No. | b | b | b | b | b | b | b |
| | Hardness H4 (Shore D) | 54 | 54 | 54 | 54 | 54 | 54 | 54 |
| | Content (%) of elements having a hitting deformation ratio of 30% or more | 0 | 0 | 0 | 0 | 0 | 0 | 0 |
| | Thickness (mm) | 4.9 | 2.4 | 4.9 | 4.9 | 2.4 | 2.4 | 2.4 |
| | Radius cumulation (%) | 93.0 | 93.0 | 93.0 | 93.0 | 93.0 | 93.0 | 93.0 |
| Fifth envelope layer | Material No. | k | k | k | k | k | k | k |
| | Hardness H5 (Shore D) | 65 | 65 | 65 | 65 | 65 | 65 | 65 |
| | Content (%) of elements having a hitting deformation ratio of 30% or more | 0 | 0 | 0 | 0 | 0 | 0 | 0 |
| | Thickness (mm) | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 |
| Cover | Material No. | l | l | l | l | l | l | l |
| | Hardness Hc (Shore D) | 32 | 32 | 32 | 32 | 32 | 32 | 32 |
| | Thickness (mm) | 0.5 | 0.5 | 0.5 | 0.5 | 0.5 | 0.5 | 0.5 |

TABLE 8-continued

| | | | | | | | | |
|---|---|---|---|---|---|---|---|---|
| Hardness difference (Hh − Ho) | | 31 | 31 | 31 | 31 | 31 | 31 | 31 |
| Properties | Compression deformation amount (mm) | 2.72 | 2.80 | 2.73 | 2.70 | 2.82 | 2.69 | 2.83 |
| | Spin rate on driver shots Sd (rpm) | 2367 | 2363 | 2311 | 2440 | 2308 | 2639 | 2557 |
| | Spin rate on approach shots Sa10(rpm) | 3799 | 3749 | 3802 | 3749 | 3751 | 3713 | 3510 |
| | Sd/Sa10 | 0.62 | 0.63 | 0.61 | 0.65 | 0.62 | 0.71 | 0.73 |
| | Golf ball No. | 4-8 | 4-9 | 4-10 | 4-11 | 4-12 | 4-13 | 5-1 |
| Center | Material No. | A | A | A | A | A | A | A |
| | Central point hardness H0 (Shore D) | 34 | 34 | 34 | 34 | 34 | 34 | 34 |
| | Diameter (mm) | 15 | 20 | 20 | 15 | 15 | 15 | 15 |
| | Radius cumulation (%) | 35.0 | 46.7 | 46.7 | 35.0 | 35.0 | 35.0 | 35.0 |
| First envelope layer | Material No. | a | a | a | a | g | g | B |
| | Hardness H1 (Shore D) | 45 | 45 | 45 | 45 | 25 | 25 | 51 |
| | Content (%) of elements having a hitting deformation ratio of 30% or more | 10.2 | 37 | 89.8 | 10.2 | 10.2 | 10.2 | 100 |
| | Thickness (mm) | 2.5 | 2.5 | 5.0 | 2.5 | 2.5 | 2.5 | 12.4 |
| | Radius cumulation (%) | 46.7 | 58.4 | 70.1 | 46.7 | 46.7 | 46.7 | 93.0 |
| Second envelope layer | Material No. | h | h | g | a | a | a | k |
| | Hardness H2 (Shore D) | 15 | 15 | 25 | 45 | 45 | 45 | 65 |
| | Content (%) of elements having a hitting deformation ratio of 30% or more | 37 | 52.8 | 0 | 89.8 | 89.8 | 89.8 | 0 |
| | Thickness (mm) | 2.5 | 2.5 | 2.5 | 7.5 | 7.5 | 7.5 | 1 |
| | Radius cumulation (%) | 58.4 | 70.1 | 81.8 | 81.8 | 81.8 | 81.8 | 97.7 |
| Third envelope layer | Material No. | a | a | — | — | — | — | — |
| | Hardness H3 (Shore D) | 45 | 45 | — | — | — | — | — |
| | Content (%) of elements having a hitting deformation ratio of 30% or more | 52.8 | 0 | — | — | — | — | — |
| | Thickness (mm) | 5.0 | 2.5 | — | — | — | — | — |
| | Radius cumulation (%) | 81.8 | 81.8 | — | — | — | — | — |
| Fourth envelope layer | Material No. | b | b | b | b | b | g | — |
| | Hardness H4 (Shore D) | 54 | 54 | 54 | 54 | 54 | 25 | — |
| | Content (%) of elements having a hitting deformation ratio of 30% or more | 0 | 0 | 0 | 0 | 0 | 0 | — |
| | Thickness (mm) | 2.4 | 2.4 | 2.4 | 2.4 | 2.4 | 2.4 | — |
| | Radius cumulation (%) | 93.0 | 93.0 | 93.0 | 93.0 | 93.0 | 93.0 | — |
| Fifth envelope layer | Material No. | k | k | k | k | k | k | — |
| | Hardness H5 (Shore D) | 65 | 65 | 65 | 65 | 65 | 65 | — |
| | Content (%) of elements having a hitting deformation ratio of 30% or more | 0 | 0 | 0 | 0 | 0 | 0 | — |
| | Thickness (mm) | 1.0 | 1.0 | 1.0 | 1.0 | 1.0 | 1.0 | — |
| | Radius cumulation (%) | 97.7 | 97.7 | 97.7 | 97.7 | 97.7 | 97.7 | — |
| Cover | Material No. | 1 | 1 | 1 | 1 | 1 | 1 | 1 |
| | Hardness Hc (Shore D) | 32 | 32 | 32 | 32 | 32 | 32 | 32 |
| | Thickness (mm) | 0.5 | 0.5 | 0.5 | 0.5 | 0.5 | 0.5 | 0.5 |
| Hardness difference (Hh − Ho) | | 31 | 31 | 31 | 31 | 31 | 31 | 31 |
| Properties | Compression deformation amount (mm) | 2.76 | 2.90 | 2.87 | 2.59 | 2.64 | 2.87 | 2.60 |
| | Spin rate on driver shots Sd (rpm) | 2534 | 2511 | 2701 | 2812 | 2630 | 2859 | 2300 |
| | Spin rate on approach shots Sa10(rpm) | 3741 | 3462 | 3520 | 3668 | 3676 | 3631 | 3350 |
| | Sd/Sa10 | 0.68 | 0.73 | 0.77 | 0.77 | 0.72 | 0.79 | 0.69 |

Figure 10:
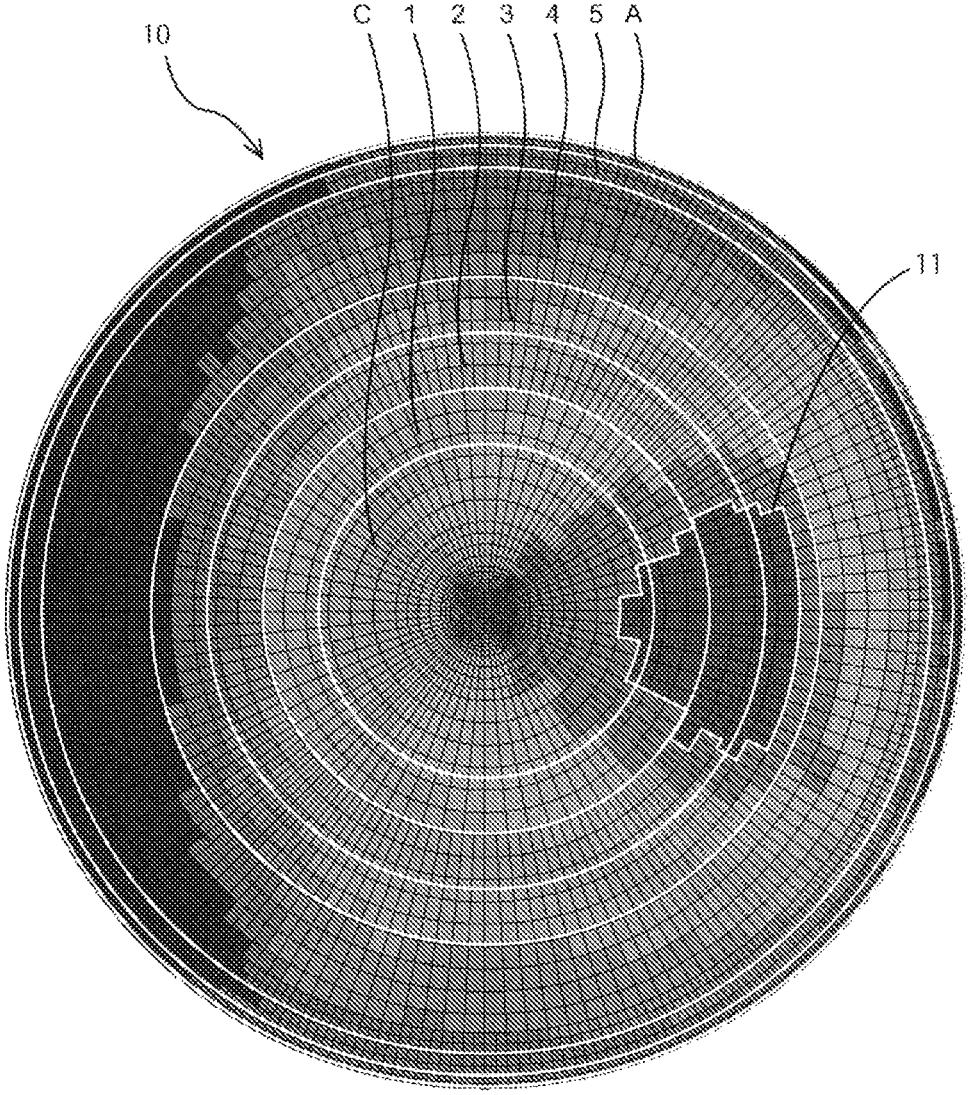
FIG. 10 is a cross-sectional view showing a layer structure of a golf ball and a region composed of elements having a hitting deformation ratio of 30.0% or more, among elements obtained by dividing a golf ball model.

FIG. 10 is a cross-sectional view showing a layer structure and a region 11 composed of elements having a hitting deformation ratio of 30.0% or more among elements obtained by dividing a golf ball model, of the golf balls No. 1-1, 1-3, 1-4, 1-5, 2-1, 3-1, 3-3, 4-1, 4-3 and 4-4. It can be seen that the spherical center C and the first envelope layer 1 to the third envelope layer 3 covering the spherical center C include the region 11 composed of the elements having a hitting deformation ratio of 30.0% or more. The material hardness (H2) of the second envelope layer located at the middle position among the adjacent three envelope layers is a lowest hardness (Hs).

Figure 11:
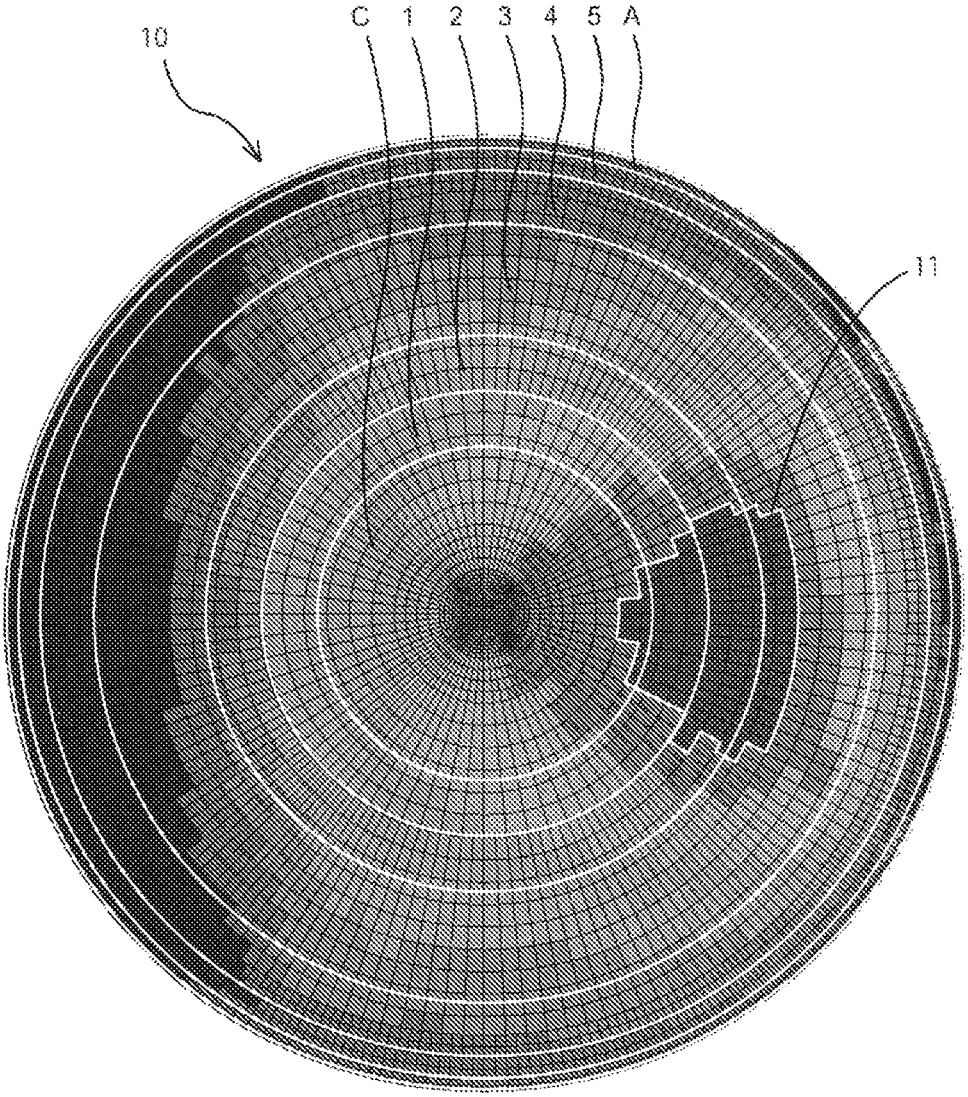
FIG. 11 is a cross-sectional view showing a layer structure of a golf ball and a region composed of elements having a hitting deformation ratio of 30.0% or more, among elements obtained by dividing a golf ball model.

FIG. 11 is a cross-sectional view showing a layer structure and a region 11 composed of elements having a hitting deformation ratio of 30.0% or more among elements obtained by dividing a golf ball model, of the golf balls No. 1-2, 1-6, 1-7, 1-9, 1-11, 1-12, 2-2, 2-4, 2-5, 2-6, 2-7, 3-2, 3-4, 3-5, 3-6, 3-7, 4-2, 4-5, 4-6 and 4-8. It can be seen that the spherical center and the first envelope layer 1 to the third envelope layer 3 covering the spherical center include the region 11 composed of the elements having a hitting deformation ratio of 30.0% or more. The material hardness (H2) of the second envelope layer located at the middle position among the adjacent three envelope layers is a lowest hardness (Hs).

Figure 12:
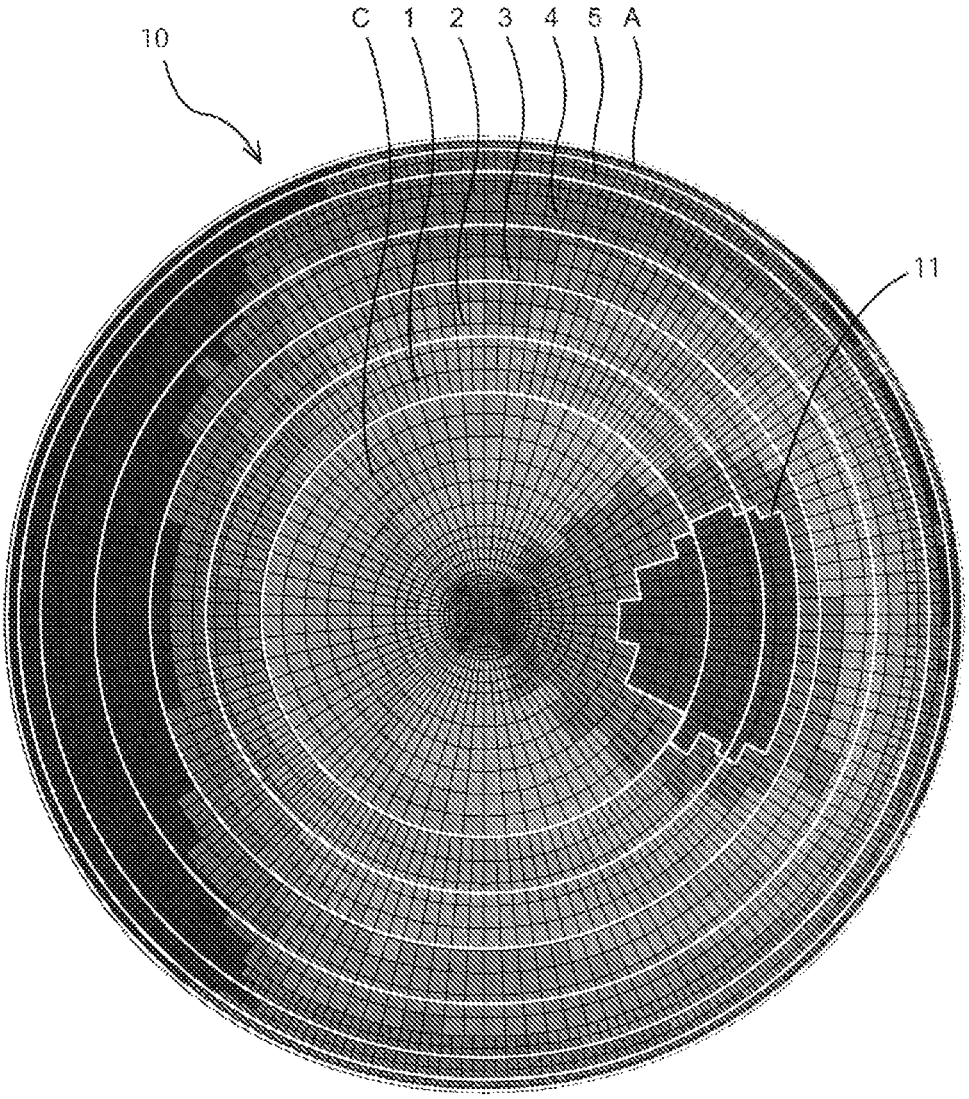
FIG. 12 is a cross-sectional view showing a layer structure of a golf ball and a region composed of elements having a hitting deformation ratio of 30.0% or more, among elements obtained by dividing a golf ball model.

FIG. 12 is a cross-sectional view showing a layer structure and a region 11 composed of elements having a hitting deformation ratio of 30.0% or more among elements obtained by dividing a golf ball model, of the golf balls No. 1-8, 1-10, 4-7 and 4-9. It can be seen that the spherical center and the first envelope layer 1 to the second envelope layer 2 covering the spherical center include the region 11 composed of the elements having a hitting deformation ratio of 30.0% or more. The material hardness (H2) of the second envelope layer is a lowest hardness (Hs).

Figure 13:
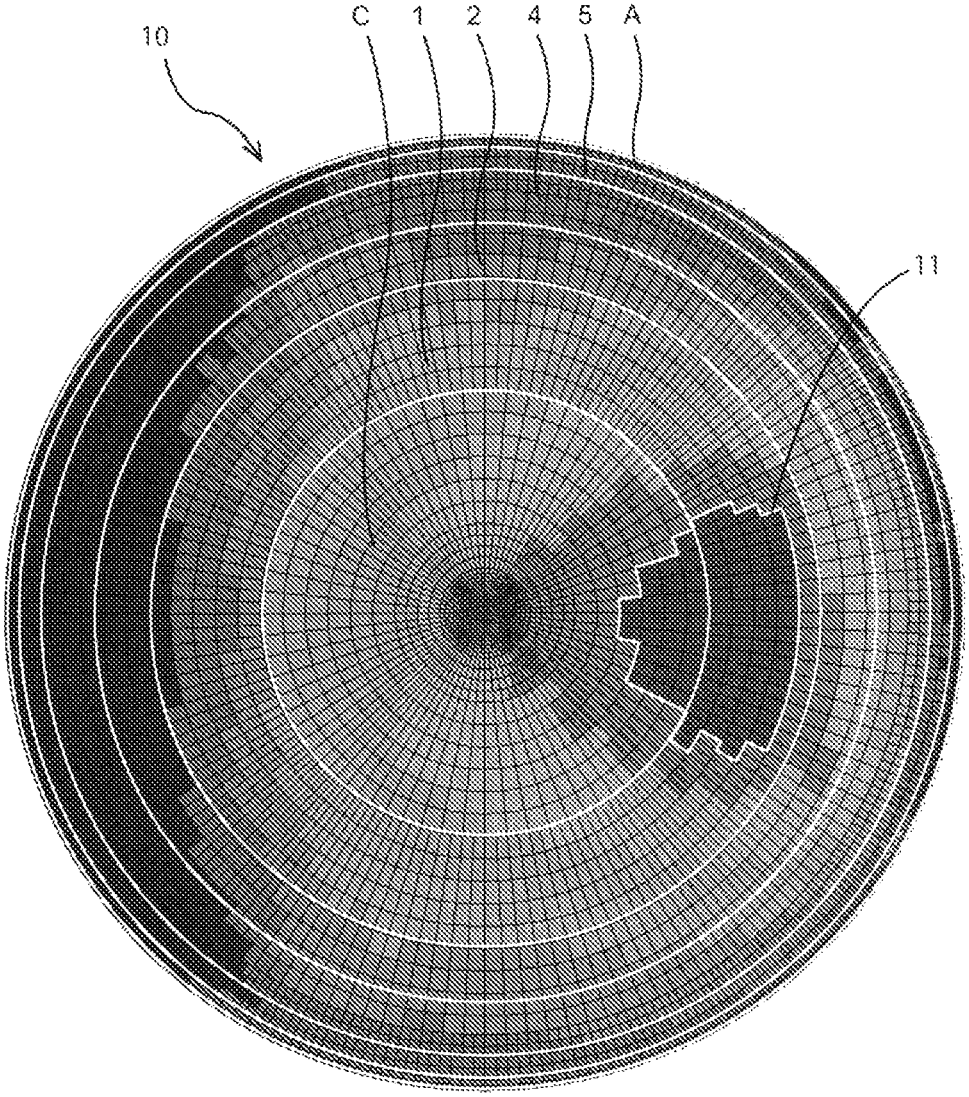
FIG. 13 is a cross-sectional view showing a layer structure of a golf ball and a region composed of elements having a hitting deformation ratio of 30.0% or more, among elements obtained by dividing a golf ball model.

FIG. 13 is a cross-sectional view showing a layer structure and a region 11 composed of elements having a hitting deformation ratio of 30.0% or more among elements obtained by dividing a golf ball model, of the golf balls No. 1-13, 2-8, 3-8 and 4-10. It can be seen that the spherical center and the first envelope layer covering the spherical center include the region composed of the elements having a hitting deformation ratio of 30.0% or more. The material hardness (H2) of the second envelope layer is a lowest hardness (Hs). In FIG. 13, in order to keep consistent with the descriptions in tables, the fourth envelope layer 4 and the fifth envelope layer 5 are disposed on the outer side of the second envelope layer 2.

Figure 14:
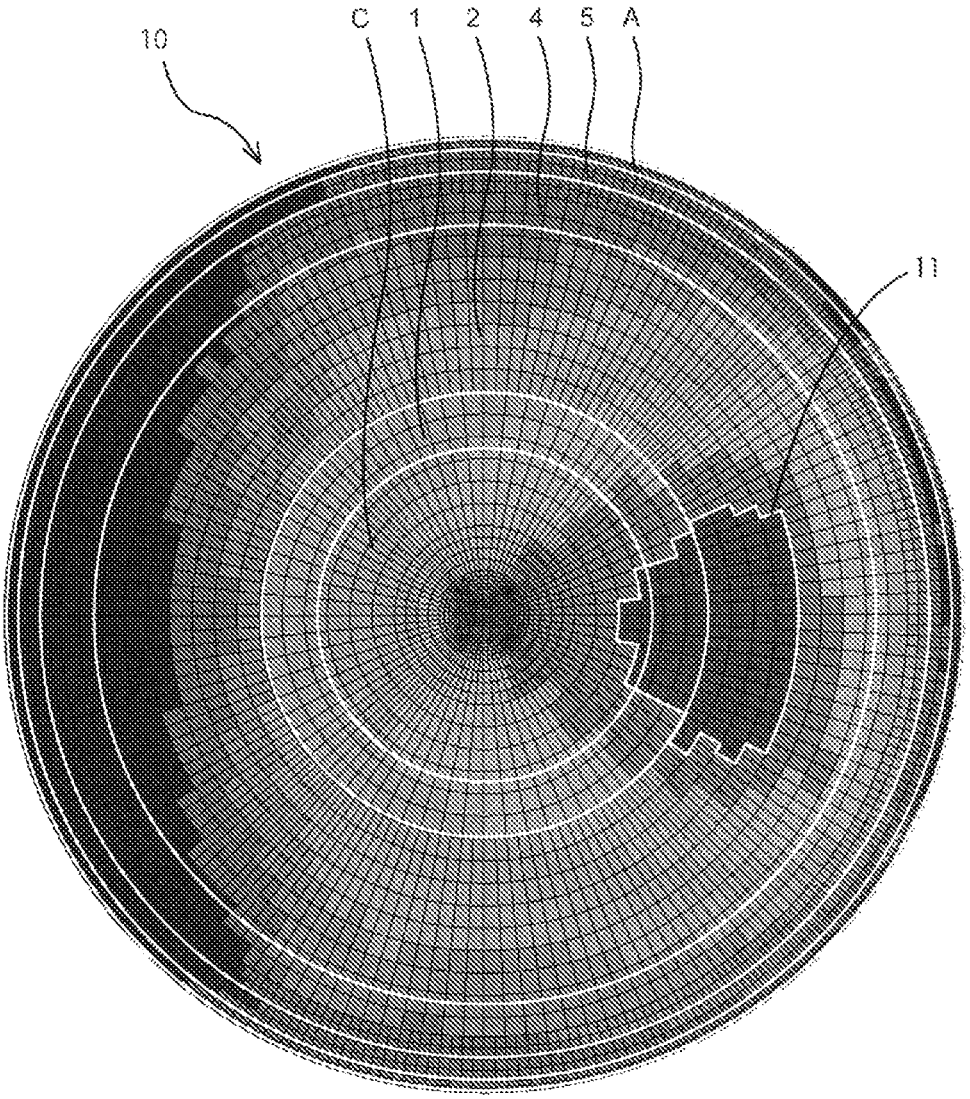
FIG. 14 is a cross-sectional view showing a layer structure of a golf ball and a region composed of elements having a hitting deformation ratio of 30.0% or more, among elements obtained by dividing a golf ball model.

FIG. 14 is a cross-sectional view showing a layer structure and a region 11 composed of elements having a hitting deformation ratio of 30.0% or more among elements obtained by dividing a golf ball model, of the golf balls No. 1-14, 1-15, 1-16, 2-9, 2-10, 2-11, 3-9, 3-10, 3-11, 4-11, 4-12 and 4-13. It can be seen that the spherical center and the first envelope layer 1 to the second envelope layer 2 covering the spherical center include the region 11 composed of the elements having a hitting deformation ratio of 30.0% or more. The material hardness (H1) of the first envelope layer is a lowest hardness (Hs), or equal to the material hardness (H2) of the second envelope layer. In FIG. 14, in order to keep consistent with the descriptions in tables, the fourth envelope layer 4 and the fifth envelope layer 5 are disposed on the outer side of the second envelope layer.

Figure 15:
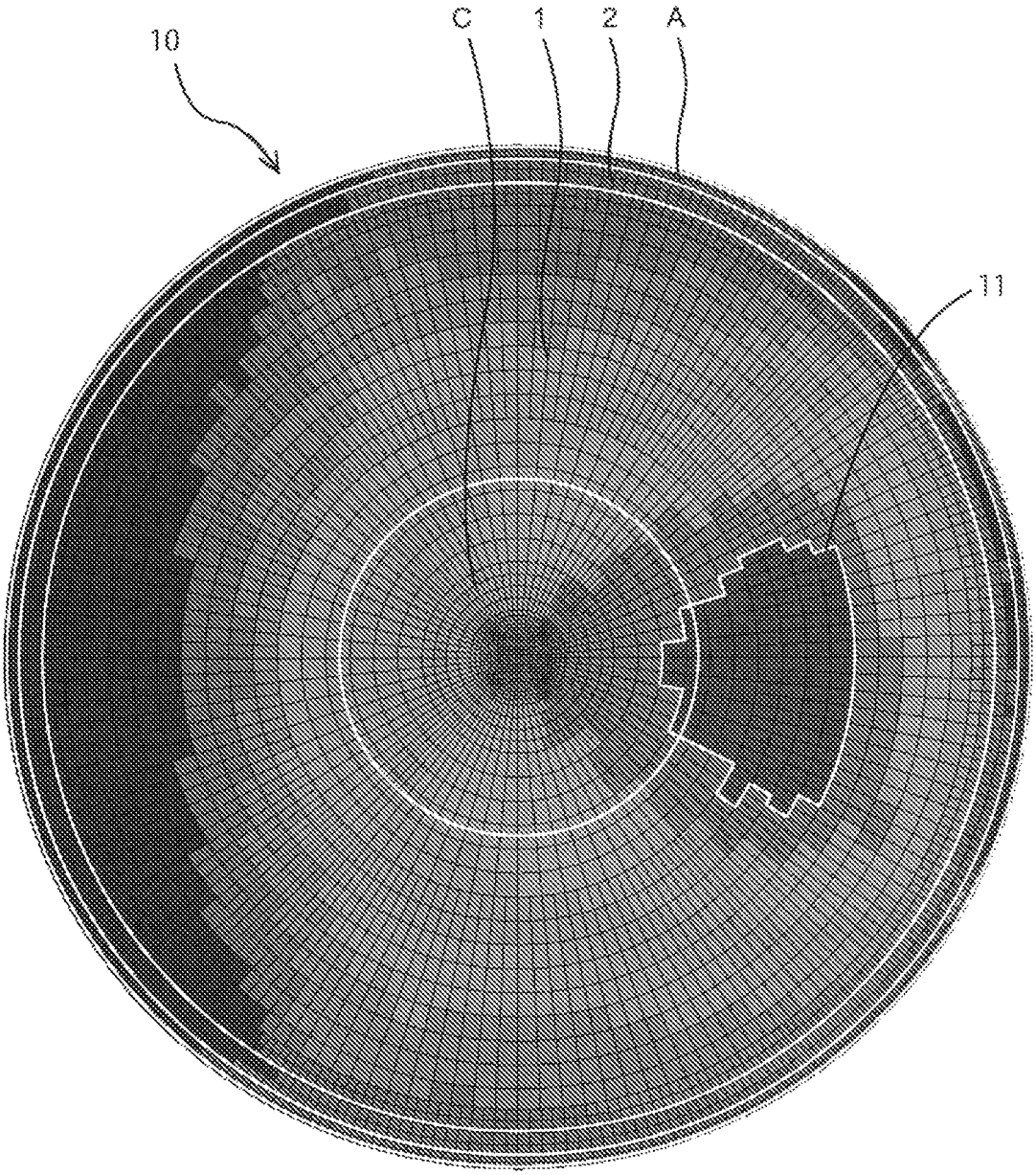
FIG. 15 is a cross-sectional view showing a layer structure of a golf ball and a region composed of elements having a hitting deformation ratio of 30.0% or more, among elements obtained by dividing a golf ball model.

FIG. 15 is a cross-sectional view showing a layer structure and a region 11 composed of elements having a hitting deformation ratio of 30.0% or more among elements obtained by dividing a golf ball model, of the golf ball No. 5-1. It can be seen that the spherical center and the first envelope layer 1 covering the spherical center include the region 11 composed of the elements having a hitting deformation ratio of 30.0% or more. The material hardness (H1) of the first envelope layer is a lowest hardness (Hs).

As shown in Tables 5-8, it can be seen that the following multi-piece golf ball of the present invention shows a low spin rate on driver shots relative to a spin rate on approach shots. As a result, the golf ball of the present invention travels a long distance on driver shots and stops steadily on approach shots. The multi-piece golf ball of the present invention comprises a spherical center, three or more envelope layers covering the spherical center, and a cover covering the envelope layers, wherein adjacent two envelope layers are formed so as to include a region composed of elements having a hitting deformation ratio of 30% or more, the hitting deformation ratio being obtained by analyzing a golf ball model described in Table 1 shown above by a finite element method; and the envelope layer which is radially outwardly of the adjacent two envelope layers has a lowest hardness among all the envelope layers.

The golf ball of the present invention is useful as a golf ball travelling a long distance on driver shots and stopping steadily on approach shots. The golf ball of the present invention is suitable as a golf ball for a golfer who hits the golf ball at a head speed of 40 m/s or more. This application is based on Japanese Patent Application No. 2014-266652 filed on Dec. 26, 2014, and No. 2015-108705 filed on May 28, 2015, the contents of which are hereby incorporated by reference.

The invention claimed is:

1. A multi-piece golf ball comprising a spherical center, three or more envelope layers covering the spherical center, and a cover covering the envelope layers, wherein two adjacent envelope layers are formed so as to include a deformation region which is composed of elements having a hitting deformation ratio of 30% or more obtained by analyzing a golf ball model using a finite element method;

the envelope layer that is radially outwardly positioned of the two adjacent envelope layers formed to include the deformation region has a hardness (Hs) that is lowest among all the envelope layers;

the golf ball model comprises a twelve-layered spherical core, an intermediate layer covering the spherical core, and a cover covering the intermediate layer, and has a configuration described in Table 1 shown below; and the elements are formed by dividing the golf ball model by radial lines, circumferential lines (longitudinal direction) and circumferential lines (latitudinal direction), the hitting deformation ratio of each element is obtained by calculating the deformation ratio (von Mises strain) at the time when the golf ball model most deforms under the condition that a rigid plate (weight: 193.8 g, size: 30 mm×40 mm×0.2 mm) collides against the golf ball model at a speed of 40 m/s and a loft angle of 12 degrees, the length of each element on a vertical cross section including the central point and the hitting point of the golf ball model in the radial direction is set at 0.5 mm in a distance range of 2 to 4 mm from the central point, is set at 1.0 mm in a distance range of 4 to 18 mm from the central point, is set at 0.85 mm in a distance range of 18 to 18.85 mm from the central point, is set at 0.5 mm in a distance range of 18.85 mm to 20.85 mm from the central point, and is set at 0.25 mm in a distance range of 20.85 to 21.35 mm from the central point, the number of element divisions on the vertical cross section of the golf ball model in the circumferential direction is set at 80 in a distance range of 2 to 10 mm from the central point, is set at 160 in a distance range of 10 to 18.85 mm from the central point, and is set at 320 in a distance range of 18.85 to 21.35 mm from the central point, the elements having a hitting deformation ratio of 30% or more are elements on the vertical cross section classified based on the hitting deformation ratio

TABLE 1

| | Distance (mm) from central point of golf ball | Distance (%) from central point of golf ball | Hardness (Shore C) | Tensile modulus (MPa) | Poisson's ratio | Density (g/cm$^3$) |
|---|---|---|---|---|---|---|
| Core 1 | 0-2.00 mm | 0%-9.4% | 70 | 53 | 0.49 | 1.118 |
| Core 2 | 2.00-4.00 mm | 9.4%-18.7% | 72 | 57 | 0.49 | 1.118 |
| Core 3 | 4.00-6.00 mm | 18.7%-28.1% | 73 | 64 | 0.49 | 1.118 |
| Core 4 | 6.00-8.00 mm | 28.1%-37.5% | 74 | 65 | 0.49 | 1.118 |
| Core 5 | 8.00-10.00 mm | 37.5%-46.8% | 74 | 65 | 0.49 | 1.118 |
| Core 6 | 10.00-12.00 mm | 46.8%-56.2% | 74 | 65 | 0.49 | 1.118 |
| Core 7 | 12.00-14.00 mm | 56.2%-65.6% | 74 | 65 | 0.49 | 1.118 |
| Core 8 | 14.00-16.00 mm | 65.6%-74.9% | 77 | 77 | 0.49 | 1.118 |
| Core 9 | 16.00-18.00 mm | 74.9%-84.3% | 77 | 77 | 0.49 | 1.118 |
| Core 10 | 18.00-18.85 mm | 84.3%-88.3% | 79 | 88 | 0.49 | 1.118 |
| Core 11 | 18.85-19.35 mm | 88.3%-90.6% | 81 | 97 | 0.49 | 1.118 |
| Core 12 | 19.35-19.85 mm | 90.6%-93.0% | 83 | 108 | 0.49 | 1.118 |
| Intermediate layer | 19.85-20.85 mm | 93.0%-97.7% | 94 | 290 | 0.49 | 0.989 |
| Cover | 20.85-21.35 mm | 97.7%-100% | 46 | 16 | 0.49 | 1.101. |

2. The multi-piece golf ball according to claim 1, wherein three adjacent envelope layers are formed so as to include the deformation region composed of the elements having the hitting deformation ratio of 30% or more; and the envelope layer among these three adjacent envelope layers that is positioned radially between the other two envelope layers has a hardness (Hs) that is lowest among all the envelope layers.

3. The multi-piece golf ball according to claim 2, wherein all the envelope layers, including the deformation region composed of the elements having the hitting deformation ratio of 30% or more, have a slab hardness of 50 or less in Shore D hardness.

4. The multi-piece golf ball according to claim 1, wherein the spherical center includes the deformation region composed of the elements having the hitting deformation ratio of 30% or more.

5. The multi-piece golf ball according to claim 1, wherein the spherical center has a material hardness of 15 or more and 55 or less in Shore D hardness.

6. The multi-piece golf ball according to claim 1, wherein the lowest hardness (Hs) is 40 or less in Shore D hardness.

7. The multi-piece golf ball according to claim 1, wherein the outermost envelope layer is an envelope layer having a hardness (Hh) that is highest among all the envelope layers.

8. The multi-piece golf ball according to claim 7, wherein the envelope layer having the highest hardness (Hh) among all the envelope layers has a material hardness of 30 or more and 85 or less in Shore D hardness.

9. The multi-piece golf ball according to claim 7, wherein a hardness difference (highest hardness (Hh)−lowest hardness (Hs)) between the highest hardness (Hh) and the lowest hardness (Hs) is 30 or more and 80 or less in Shore D hardness.

10. The multi-piece golf ball according to claim 1, wherein a material forming the envelope layer having the lowest hardness (Hs) among all the envelope layers has a tensile elastic modulus of 1 MPa or more and 20 MPa or less.

11. The multi-piece golf ball according to claim 7, wherein a material forming the envelope layer having the highest hardness among all the envelope layers has a tensile elastic modulus of 150 MPa or more and 400 MPa or less.

12. The multi-piece golf ball according to claim 5, wherein a hardness difference (material hardness (Ho) of spherical center−lowest hardness (Hs)) between the material hardness of the spherical center and the lowest hardness is 1 or more and 50 or less in Shore D hardness.

13. The multi-piece golf ball according to claim 7, wherein a hardness difference (highest hardness (Hh)−material hardness (Ho) of spherical center) between the highest hardness (Hh) and the material hardness (Ho) of the spherical center is 1 or more and 70 or less in Shore D hardness.

14. The multi-piece golf ball according to claim 1, wherein a material forming the spherical center has a tensile elastic modulus of 15 MPa or more and 80 MPa or less.

15. The multi-piece golf ball according to claim 1, wherein the cover has a material hardness of 5 or more and 55 or less in Shore D hardness.

16. The multi-piece golf ball according to claim 1, wherein a resin component constituting the envelope layer having the lowest hardness among all the envelope layers contains an ionomer resin and a thermoplastic styrene-based elastomer.

17. The multi-piece golf ball according to claim 16, wherein a mass ratio of the ionomer resin to the thermoplastic styrene-based elastomer (ionomer resin/thermoplastic styrene-based elastomer) is 0.1 or more and 3.0 or less.

18. The multi-piece golf ball according to claim 7, wherein a resin component constituting the envelope layer having the highest hardness among all the envelope layers contains an ionomer resin.

19. The multi-piece golf ball according to claim 18, wherein a content of the ionomer resin in the resin component is 50 mass % or more.

20. The multi-piece golf ball according to claim 1, wherein a material forming the cover contains a thermoplastic polyurethane resin in a resin component thereof.

21. The multi-piece golf ball according to claim 1, wherein three adjacent envelope layers are formed so as to include the deformation region composed of the elements having the hitting deformation ratio of 30% or more, all the envelope layers, including the deformation region composed of the elements having the hitting deformation ratio of 30% or more, have a slab hardness of 50 or less in Shore D, the envelope layer from the three adjacent envelope layers forming the deformation region that is positioned radially between the other two envelope layers has a hardness (Hs) that is lowest among all the envelope layers, the lowest hardness (Hs) is 40 or less in Shore D hardness, the spherical center includes the region composed of the elements having the hitting deformation ratio of 30% or more, the spherical center has a material hardness of 15 or more and 55 or less in Shore D hardness, and the outermost envelope layer is an envelope layer having a hardness (Hh) that is highest among all the envelope layers.

* * * * *